US011208864B2

(12) United States Patent
Parks et al.

(10) Patent No.: US 11,208,864 B2
(45) Date of Patent: Dec. 28, 2021

(54) INFLATABLE DOWNHOLE PACKER TOOL

(71) Applicant: Schlumberger Technology Corporation, Sugar Land, TX (US)

(72) Inventors: Stephen Parks, Houston, TX (US); Juan Miguel La Rotta Marin, Aberdeen (GB); Adam Cygan, Sugar Land, TX (US); Adriaan Gisolf, Aberdeen (GB); Adame Kante, Sugar Land, TX (US); Thomas Pfeiffer, Katy, TX (US)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 867 days.

(21) Appl. No.: 15/957,953

(22) Filed: Apr. 20, 2018

(65) Prior Publication Data

US 2019/0323317 A1 Oct. 24, 2019

(51) Int. Cl.
*E21B 33/12* (2006.01)
*E21B 33/124* (2006.01)
*E21B 23/06* (2006.01)

(52) U.S. Cl.
CPC ..... *E21B 33/1246* (2013.01); *E21B 23/06* (2013.01)

(58) Field of Classification Search
CPC .. E21B 33/1216; E21B 33/122; E21B 33/124; E21B 33/1243; E21B 33/1246; E21B 33/1277; E21B 23/06
See application file for complete search history.

(56) References Cited

U.S. PATENT DOCUMENTS 4,892,144 A * 1/1990 Coone ..... E21B 33/1277 166/122
5,383,520 A * 1/1995 Tucker ..... E21B 23/006 166/142
5,417,289 A * 5/1995 Carisella ..... E21B 33/1277 166/120
5,526,878 A * 6/1996 Duell ..... E21B 33/127 166/187
2007/0056749 A1* 3/2007 Gambier ..... E21B 33/127 166/387
2009/0025983 A1* 1/2009 Ellson ..... E21B 33/1285 175/230
2010/0170682 A1* 7/2010 Brennan, III ..... E21B 33/1277 166/387

* cited by examiner

*Primary Examiner* — Christopher J Sebesta
(74) *Attorney, Agent, or Firm* — Trevor G. Grove

(57) ABSTRACT

An inflatable packer assembly configured to be conveyed within a wellbore. The inflatable packer assembly includes a mandrel having a flowline, a first packer ring slidably connected with the mandrel, a second packer ring fixedly connected with the mandrel, a latching mechanism fluidly connected with the flowline, and an inflatable packer fluidly connected with the flowline. The inflatable packer may be disposed around the mandrel and sealingly connected with the first and second packer rings. The inflatable packer may be operable to expand against a sidewall of the wellbore upon receiving a fluid from the flowline. The latching mechanism may be operable to limit movement of the first packer ring with respect to the mandrel, and permit the movement of the first packer ring with respect to the mandrel upon being actuated by the fluid from the flowline.

19 Claims, 9 Drawing Sheets

INFLATABLE DOWNHOLE PACKER TOOL

BACKGROUND OF THE DISCLOSURE

In the oil and gas industry, downhole tool strings include inflatable packer tools. For example, a dual-packer tool may be positioned at an intended location within a wellbore and expandable packer elements of the packer tool may be radially expanded to form an annular seal against the wellbore wall or a casing lining the wellbore to fluidly isolate an interval (i.e., section) of the wellbore between the packer elements.

A typical inflatable dual-packer tool comprises upper (i.e., uphole) packer rings that are fixedly connected with corresponding mandrels, and lower (i.e., downhole) packer rings that are slidably connected with the corresponding mandrels. Such relative locations of the fixed and slidable packer rings reduce the risk of expandable packer elements sticking when conveying the packer tool upwards (i.e., uphole) out of the wellbore. Namely, during upward conveyance, axial movement (i.e., sliding) of the lower packer rings permits the packer elements to slim down when passing a restriction within the wellbore. From an operational perspective, the risk of not being able to convey the packer tool into the wellbore is deemed less than not being able to convey the packer tool out of the wellbore.

However, mounting the packer rings on the mandrels in such manner results in one of the sliding rings facing the isolated wellbore interval. Dynamic downhole conditions, such as differential between fluid pressure within the isolated interval and hydrostatic wellbore pressure external to the expanded packer elements, may cause the sliding ring to move during downhole operations, causing length and volume of the isolated wellbore interval to vary during downhole measuring operations. Such interval variations can introduce artifacts in the pressure readings and impact the ability to interpret measurement data. Having one of the sliding packer rings facing the isolated wellbore interval also reduces the maximum pressure differential limit of the dual-packer tool. Namely, mounting one of the sliding packer rings in such orientation requires that both the fixed and slidable packer rings first pass over an end connector (e.g., threads) of the corresponding mandrel, thereby limiting the size and the strength of such end connector. From an operational perspective, the potential for increased differential pressure rating and better quality pressure data is deemed less imperative than the ability to convey the packer tool out of the wellbore.

SUMMARY OF THE DISCLOSURE

This summary is provided to introduce a selection of concepts that are further described below in the detailed description. This summary is not intended to identify indispensable features of the claimed subject matter, nor is it intended for use as an aid in limiting the scope of the claimed subject matter.

The present disclosure introduces an apparatus that includes a dual packer assembly for conveyance within a wellbore. The dual packer assembly includes an upper packer assembly and a lower packer assembly. The upper packer assembly includes an upper mandrel, a first upper packer ring axially movable with respect to the upper mandrel, a first lower packer ring fixedly connected with the upper mandrel, and an upper inflatable packer disposed around the upper mandrel and sealingly connected with the first upper and first lower packer rings. The upper inflatable packer is operable to expand against a sidewall of the wellbore. The lower packer assembly includes a lower mandrel coupled with the upper mandrel, a second upper packer ring fixedly connected with the lower mandrel, a second lower packer ring axially movable with respect to the lower mandrel, and a lower inflatable packer disposed around the lower mandrel and sealingly connected with the second upper and second lower packer rings. The lower inflatable packer is operable to expand against the sidewall of the wellbore, and the upper and lower inflatable packers are collectively operable to isolate a section of the wellbore when expanded.

The present disclosure also introduces an apparatus that includes an inflatable packer assembly for conveyance within a wellbore, the inflatable packer assembly includes a mandrel, a first packer ring, a second packer ring, a latching mechanism, and an inflatable packer. The mandrel includes a flowline. The first packer ring is slidably connected with the mandrel. The second packer ring is fixedly connected with the mandrel. The latching mechanism is fluidly connected with the flowline, and is operable to limit movement of the first packer ring with respect to the mandrel, and to permit the movement of the first packer ring with respect to the mandrel upon being actuated by a fluid from the flowline. The inflatable packer is disposed around the mandrel, and is sealingly connected with the first and second packer rings. The inflatable packer is fluidly connected with the flowline, and is operable to expand against a sidewall of the wellbore upon receiving the fluid from the flowline.

The present disclosure also introduces a method that includes coupling an inflatable packer assembly to a tool string. The inflatable packer assembly includes a mandrel, an upper packer ring, a lower packer ring, a latching mechanism, and an inflatable packer. The mandrel includes a flowline extending within the mandrel. The upper packer ring is selectively axially movable with respect to the mandrel. The lower packer ring is fixedly connected with the mandrel. The latching mechanism is fluidly connected with the flowline. The inflatable packer is disposed around the mandrel and sealingly connected with the upper and lower packer rings. The inflatable packer is fluidly connected with the flowline. The method also includes conveying the tool string in a downhole direction within a wellbore, and pumping a fluid into the flowline. The pumped fluid expands the inflatable packer away from the mandrel and against a sidewall of the wellbore, and also operates the latching mechanism to permit the axial movement of the upper packer ring with respect to the mandrel. The method also includes conveying the tool string in an uphole direction within the wellbore while the latching mechanism is limiting the axial movement of the upper packer ring with respect to the mandrel.

These and additional aspects of the present disclosure are set forth in the description that follows, and/or may be learned by a person having ordinary skill in the art by reading the materials herein and/or practicing the principles described herein. At least some aspects of the present disclosure may be achieved via means recited in the attached claims.

BRIEF DESCRIPTION OF THE DRAWINGS

The present disclosure is understood from the following detailed description when read with the accompanying figures. It is emphasized that, in accordance with the standard practice in the industry, various features are not drawn to scale. In fact, the dimensions of the various features may be arbitrarily increased or reduced for clarity of discussion.

DETAILED DESCRIPTION

Figure 1:
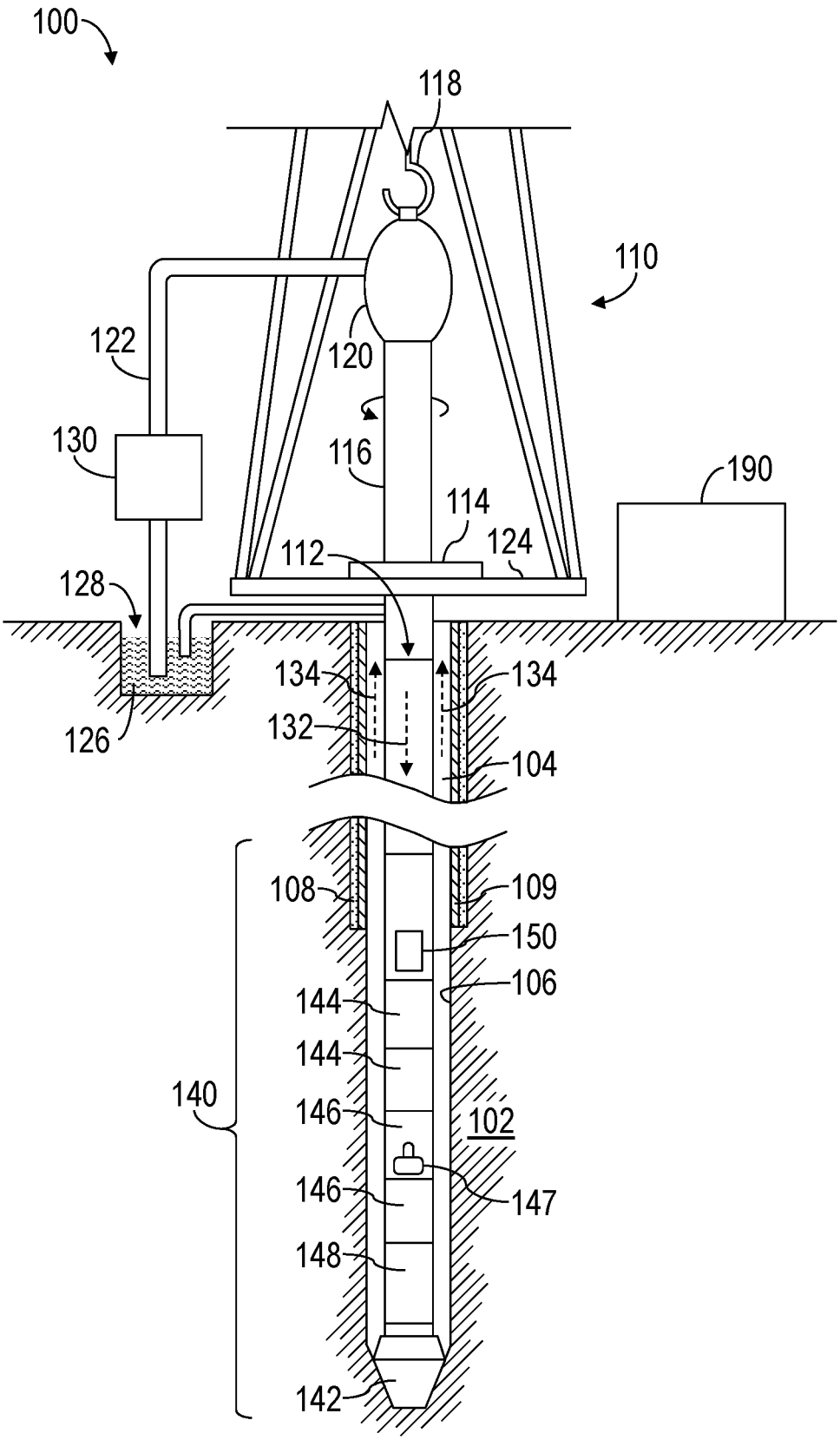
FIG. 1 is a schematic view of at least a portion of an example implementation of apparatus according to one or more aspects of the present disclosure.

It is to be understood that the following disclosure provides many different examples for different features and other aspects of various implementations. Specific examples of components and arrangements are described below to simplify the present disclosure. These are merely examples, and are not intended to be limiting. In addition, the present disclosure may repeat reference numerals and/or letters in the various examples. This repetition is for simplicity and clarity, and does not in itself dictate a relationship between the various implementations described below.

FIG. 1 is a schematic view of an example wellsite system 100 to which one or more aspects of the present disclosure may be applicable. The wellsite system 100 may be onshore or offshore. In the example wellsite system 100 shown in FIG. 1, a wellbore 104 is formed in one or more subterranean formations 102 by rotary drilling. Other example systems within the scope of the present disclosure may also or instead utilize directional drilling. Although some elements of the wellsite system 100 are depicted in FIG. 1 and described below, it is to be understood that the wellsite system 100 may include other components in addition to, or instead of, those presently illustrated and described.

As shown in FIG. 1, a drillstring 112 suspended within the wellbore 104 comprises a bottom hole assembly (BHA) 140 that includes or is coupled with a drill bit 142 at its lower end. The surface system includes a platform and derrick assembly 110 positioned over the wellbore 104. The platform and derrick assembly 110 may comprise a rotary table 114, a kelly 116, a hook 118, and a rotary swivel 120. The drillstring 112 may be suspended from a lifting gear (not shown) via the hook 118, with the lifting gear being coupled to a mast (not shown) rising above the surface. An example lifting gear includes a crown block affixed to the top of the mast, a vertically traveling block to which the hook 118 is attached, and a cable passing through the crown block and the vertically traveling block. In such an example, one end of the cable is affixed to an anchor point, whereas the other end is affixed to a winch to raise and lower the hook 118 and the drillstring 112 coupled thereto. The drillstring 112 comprises one or more types of tubular members, such as drill pipes, threadedly attached one to another, perhaps including wired drilled pipe.

The drillstring 112 may be rotated by the rotary table 114, which engages the kelly 116 at the upper end of the drillstring 112. The drillstring 112 is suspended from the hook 118 in a manner permitting rotation of the drillstring 112 relative to the hook 118. Other example wellsite systems within the scope of the present disclosure may utilize a top drive system to suspend and rotate the drillstring 112, whether in addition to or instead of the illustrated rotary table system.

The surface system may further include drilling fluid or mud 126 stored in a pit or other container 128 formed at the wellsite. The drilling fluid 126 may be oil-based mud (OBM) or water-based mud (WBM). A pump 130 delivers the drilling fluid 126 to the interior of the drillstring 112 via a hose or other conduit 122 coupled to a port in the rotary swivel 120, causing the drilling fluid to flow downward through the drillstring 112, as indicated in FIG. 1 by directional arrow 132. The drilling fluid exits the drillstring 112 via ports in the drill bit 142, and then circulates upward through the annulus region between the outside of the drillstring 112 and the wall 106 of the wellbore 104, as indicated in FIG. 1 by directional arrows 134. In this manner, the drilling fluid 126 lubricates the drill bit 142 and carries formation cuttings up to the surface while it is returned to the container 128 for recirculation.

The BHA 140 may comprise one or more specially made drill collars near the drill bit 142. Each such drill collar may comprise one or more devices permitting measurement of downhole drilling conditions and/or various characteristic properties of the subterranean formation 102 intersected by the wellbore 104. For example, the BHA 140 may comprise one or more logging-while-drilling (LWD) modules 144, one or more measurement-while-drilling (MWD) modules 146, a rotary-steerable system and motor 148, and perhaps the drill bit 142. Other BHA components, modules, and/or tools are also within the scope of the present disclosure, and such other BHA components, modules, and/or tools may be positioned differently in the BHA 140 than as depicted in FIG. 1.

The LWD modules 144 may comprise one or more devices for measuring characteristics of the formation 102, including for obtaining a sample of fluid from the formation 102. The MWD modules 146 may comprise one or more devices for measuring characteristics of the drillstring 112 and/or the drill bit 142, such as for measuring weight-on-bit, torque, vibration, shock, stick slip, tool face direction, and/or inclination, among other examples. The MWD modules 146 may further comprise an apparatus 147 for generating electrical power to be utilized by the downhole system, such as a mud turbine generator powered by the flow of the drilling fluid 126. Other power and/or battery systems may also or instead be employed. One or more of the LWD modules 144, the MWD modules 146, and/or another drill pipe conveyed tool or module may be or comprise at least a portion of a packer tool as described below.

The wellsite system 100 also includes a data processing system that can include one or more, or portions thereof, of the following: the surface equipment 190, control devices and electronics in one or more modules of the BHA 140 (such as a downhole controller 150), a remote computer system (not shown), communication equipment, and other equipment. The data processing system may include one or more computer systems or devices and/or may be a distributed computer system. For example, collected data or information may be stored, distributed, communicated to a human wellsite operator, and/or processed locally or remotely.

The data processing system may, individually or in combination with other system components, perform the methods and/or processes described below, or portions thereof. Methods and/or processes within the scope of the present disclosure may be implemented by one or more computer programs that run in a processor located, for example, in one or more modules of the BHA 140 and/or the surface equipment 190. Such programs may utilize data received from the BHA 140 via mud-pulse telemetry and/or other telemetry means, and/or may transmit control signals to operative elements of the BHA 140. The programs may be stored on a tangible, non-transitory, computer-usable storage medium associated with the one or more processors of the BHA 140 and/or surface equipment 190, or may be stored on an external, tangible, non-transitory, computer-usable storage medium that is electronically coupled to such processor(s). The storage medium may be one or more known or future-developed storage media, such as a magnetic disk, an optically readable disk, flash memory, or a readable device of another kind, including a remote storage device coupled over a communication link, among other examples.

Figure 2:
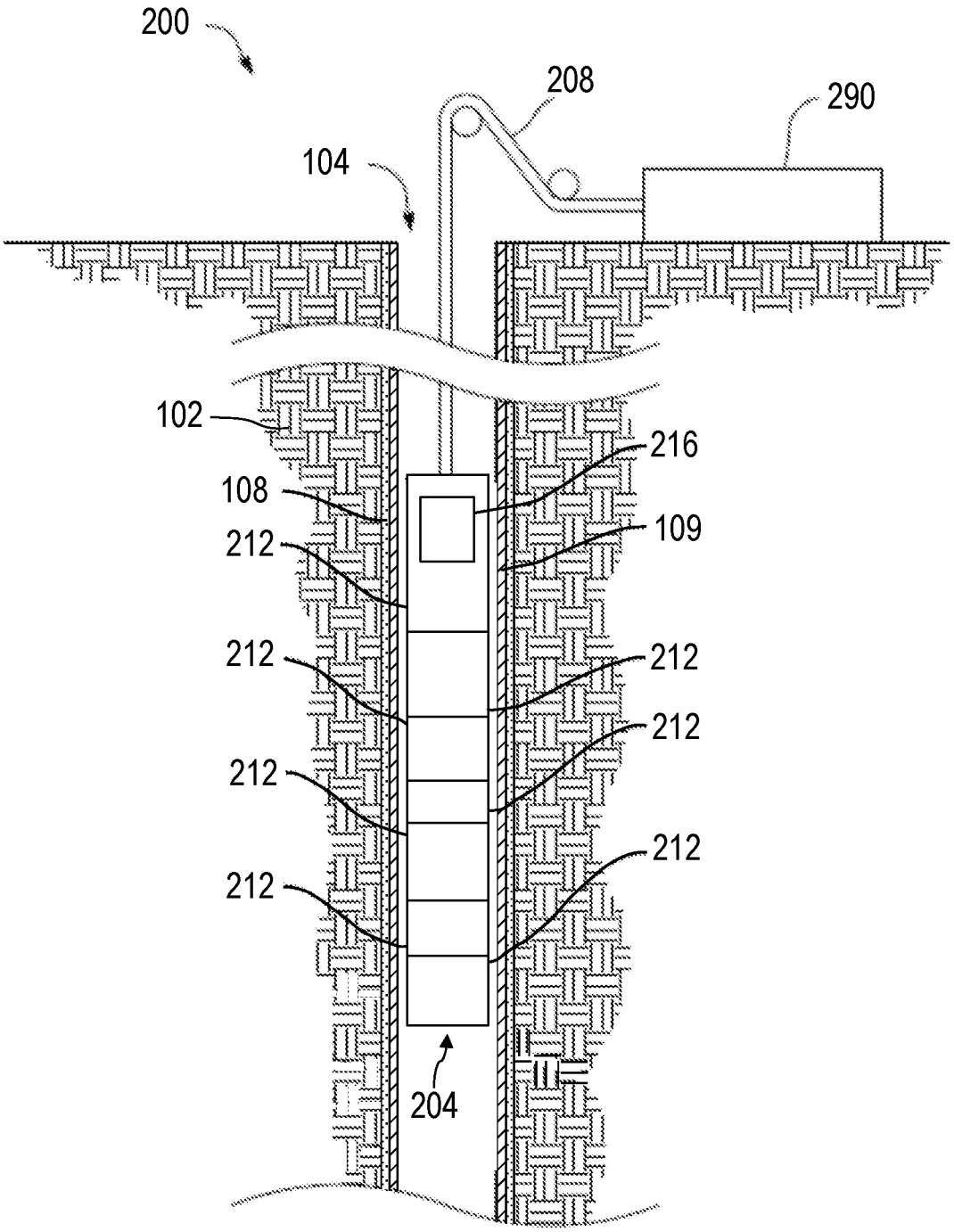
FIG. 2 is a schematic view of at least a portion of an example implementation of apparatus according to one or more aspects of the present disclosure.

FIG. 2 is a schematic view of another example wellsite system 200 to which one or more aspects of the present disclosure may be applicable. The wellsite system 200 may be onshore or offshore. In the example wellsite system 200 shown in FIG. 2, a tool string 204 is conveyed into the wellbore 104 via a conveyance means 208, which may be or comprise a wireline, a slickline, or a fluid conduit, such as coiled tubing, completion tubing, a liner, or a casing. Similarly to the wellsite system 100 shown in FIG. 1, the example wellsite system 200 of FIG. 2 may be utilized for evaluation of the wellbore 104 and/or the formation 102 penetrated by the wellbore 104.

The tool string 204 is suspended in the wellbore 104 from the lower end of the conveyance means 208, which may be a multi-conductor logging cable spooled on a surface winch (not shown). The conveyance means 208 may include at least one conductor that facilitates data communication between the tool string 204 and surface equipment 290 disposed on the surface. The surface equipment 290 may have one or more aspects in common with the surface equipment 190 shown in FIG. 1.

The tool string 204 and conveyance means 208 may be structured and arranged with respect to a service vehicle (not shown) at the wellsite. For example, the conveyance means 208 may be connected to a drum (not shown) at the wellsite surface, such that rotation of the drum may raise and lower the tool string 204. The drum may be disposed on a service vehicle or a stationary platform. The service vehicle or stationary platform may further contain the surface equipment 290.

The tool string 204 comprises one or more elongated housings encasing various electronic components and modules schematically represented in FIG. 2. For example, the illustrated tool string 204 includes several modules 212, at least one of which may be or comprise at least a portion of a packer tool as described below. Other implementations of the downhole tool string 204 within the scope of the present disclosure may include additional or fewer components or modules relative to the example implementation depicted in FIG. 2.

The wellsite system 200 also includes a data processing system that can include one or more, or portions thereof, of the following: the surface equipment 290, control devices and electronics in one or more modules of the tool string 204 (such as a downhole controller 216), a remote computer system (not shown), communication equipment, and other equipment. The data processing system may include one or more computer systems or devices and/or may be a distributed computer system. For example, collected data or information may be stored, distributed, communicated to a human wellsite operator, and/or processed locally or remotely.

The data processing system may, whether individually or in combination with other system components, perform the methods and/or processes described below, or portions thereof. Methods and/or processes within the scope of the present disclosure may be implemented by one or more computer programs that run in a processor located, for example, in one or more modules 212 of the tool string 204 and/or the surface equipment 290. Such programs may utilize data received from the downhole controller 216 and/or other modules 212 via the conveyance means 208, and may transmit control signals to operative elements of the tool string 204. The programs may be stored on a tangible, non-transitory, computer-usable storage medium associated with the one or more processors of the downhole controller 216, other modules 212 of the tool string 204, and/or the surface equipment 290, or may be stored on an external, tangible, non-transitory, computer-usable storage medium that is electronically coupled to such processor(s). The storage medium may be one or more known or future-developed storage media, such as a magnetic disk, an optically readable disk, flash memory, or a readable device of another kind, including a remote storage device coupled over a communication link, among other examples.

Although FIGS. 1 and 2 illustrate example wellsite systems 100 and 200, respectively, that convey a downhole tool/string into the wellbore 104, other example implementations consistent with the scope of this disclosure may utilize other conveyance means to convey tools/strings into the wellbore 104. Additionally, other downhole tools within the scope of the present disclosure may comprise components in a non-modular construction also consistent with the scope of this disclosure.

The present disclosure is further directed to an apparatus operable to increase differential pressure limit between an isolated wellbore interval formed by packer elements of a dual-packer tool and the wellbore external to packer elements, and may reduce artificially induced pressure fluctuations by fixing the volume of the wellbore interval. The dual-packer tool may comprise an upper and a lower mandrel. Connection between the upper and the lower mandrel is located in the isolated interval formed between the upper and lower packer elements. This connection bears the forces introduced by the differential pressure between the wellbore interval and the wellbore external to packer elements. During formation testing operations, the isolated interval is either at a lower differential pressure or at a higher differential pressure than the wellbore above or below the packer elements. This permits fluid flow from the formation into the wellbore interval or from the wellbore interval into the formation. The dual-packer tool may comprise dual fluid inlets within the isolated interval, wherein each inlet is fluidly connected to a corresponding independent pressure gauge and/or fluid analyzer. The dual inlets may be utilized when multiphase fluids are present within the isolated interval. The dynamic pressure measurement in the wellbore interval is one of the primary data streams of the formation testing tool. The magnitude of the allowable differential pressure defines the operating envelope of formation tests.

The allowable differential pressure is limited, at least in part, by the design and materials of the mandrels. The apparatus within the scope of the present disclosure may permit the packer elements to slide onto the mandrels inwardly from opposing ends of the mandrels (i.e., opposite side of the connection), posing no restriction on outer diameter of the connection, hence increasing the strength of the connection.

An upper packer element of a dual-packer tool may be connected to an upper sliding ring. The sliding ring may cause complications when conveying the packer tool upwards out of the wellbore, for example, when the upper ring is caused to slide downwards (i.e., downhole) with respect to the mandrel and increase the outside diameter of the packer element when the packer element catches an obstruction in the wellbore. To mitigate risk of sticking within the wellbore, the apparatus within the scope of the present disclosure further comprises a latching mechanism operable to lock the sliding ring in place with respect to the mandrel when the packer tool is conveyed upwards. The latching mechanism may release the sliding ring during inflation and lock the sliding ring in place during deflation of the packer elements. Accordingly, when the packer tool is conveyed upwards, downward movement of the sliding ring of the upper packer element will be limited such that the upper packer element will not deform (i.e., expand) uncontrollably when pulled through the restriction in the wellbore.

Figure 3:
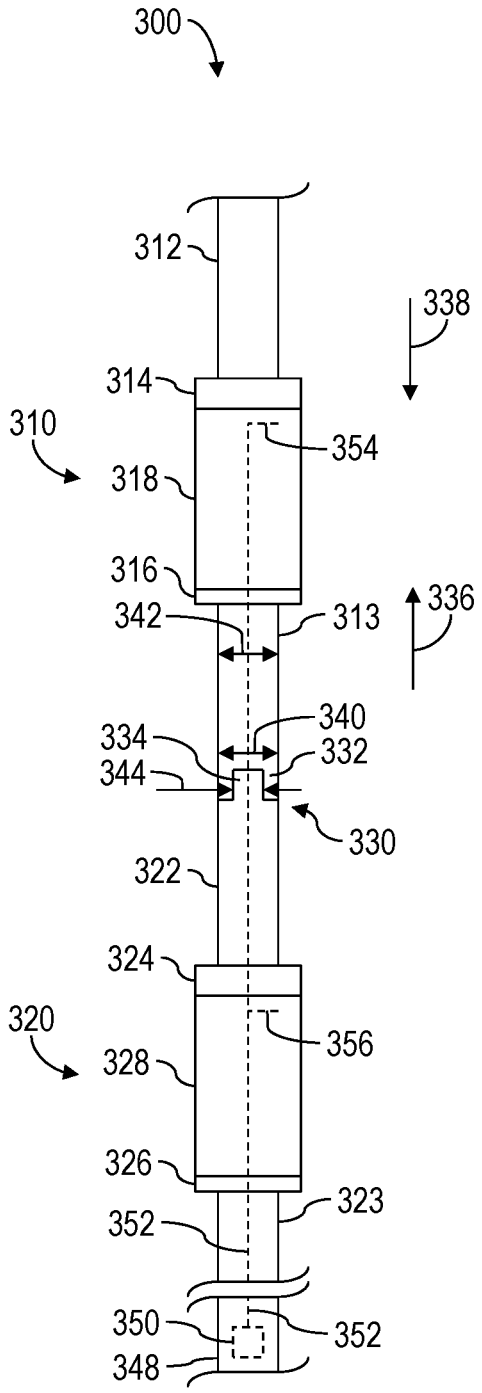
FIG. 3 PRIOR ART
FIG. 3 is a schematic view of at least a portion of an example implementation of an apparatus related to one or more aspects of the present disclosure.

FIG. 3 is a schematic view of at least a portion of an example implementation of a conventional dual-packer tool 300 configured to be conveyed within a wellbore. The dual-packer tool 300 comprises an upper packer tool 310 having an upper mandrel 312, an upper packer ring 314 fixedly connected with the upper mandrel 312, and a lower packer ring 316 slidably connected to and, thus, axially movable with respect to the upper mandrel 312. The upper packer ring 314 is fixedly connected with the upper mandrel 312 via an external coupling means (e.g., threads, a shoulder, a ring, etc.) (not shown) along an outer profile 313 (e.g., surface) of the upper mandrel 312. An inflatable (e.g., flexible, elastic) packer 318 (i.e., packer element) operable to expand against a sidewall of the wellbore is sealingly connected with the upper and lower packer rings 314, 316. The upper packer ring 314, the lower packer ring 316, and the inflatable packer 318 each comprise an axial opening or bore (not shown) configured to accommodate the upper mandrel 312 therethrough. Accordingly, the upper packer ring 314, the lower packer ring 316, and the inflatable packer 318 are each disposed around the outer profile 313 (e.g., surface) of the upper mandrel 312.

The dual-packer tool 300 further comprises a lower packer tool 320 having a lower mandrel 322, an upper packer ring 324 fixedly connected with the lower mandrel 322, and a lower packer ring 326 slidably connected to and, thus, axially movable with respect to the lower mandrel 322. The upper packer ring 324 is fixedly connected with the lower mandrel 322 via an external coupling means (not shown) along an outer profile 323 of the lower mandrel 322. An inflatable packer 328 operable to expand against the sidewall of the wellbore is sealingly connected with the upper and lower packer rings 324, 326. The upper packer ring 324, the lower packer ring 326, and the inflatable packer 328 each comprise an axial opening or bore (not shown) configured to accommodate the lower mandrel 322 therethrough. Accordingly, the upper packer ring 324, the lower packer ring 326, and the inflatable packer 328 are each disposed around the outer profile 323 of the lower mandrel 322.

In a deflated (i.e., retracted) state of each packer 318, 328, an inner surface of each packer 318, 328 may be disposed against and/or in contact with the outer profile 313, 323 of the corresponding mandrel 312, 322. In an inflated (i.e., expanded) state of each packer 318, 328, the inner surface of each packer 318, 328 may be disposed away from the outer profile 318, 328 of the corresponding mandrel 312, 322 and an outer surface of each packer 318, 328 may be disposed against the sidewall of the wellbore to fluidly isolate an interval (i.e., section) of the wellbore extending between the upper and lower packers 318, 328 and/or to maintain the dual-packer tool 300 in position within the wellbore. The slidable connection between the lower packer rings 316, 326 and the corresponding mandrels 312, 322 permit the lower packer rings 316, 326 to slide axially along the corresponding mandrels 312, 322 in an upward direction, as indicated by arrow 336, when the packers 318, 328 are being inflated, and in a downward direction, as indicated by arrow 338, when the packers 318, 328 are being deflated.

The upper and lower mandrels 312, 322 may be coupled together at a coupling joint 330. For example, a lower end of the upper mandrel 312 comprises a lower coupler 332 and an upper end of the lower mandrel 322 comprises an upper coupler 334. The lower and upper couplers 332, 334 are configured to engage each other to couple together the upper and lower mandrels 312, 322 and, thus, couple together the upper and lower packer tools 310, 320.

During assembly of the upper packer tool 310, an upper packer subassembly comprising the upper packer ring 314, the inflatable packer 318, and the lower packer ring 316 is inserted onto the outer profile 313 of the upper mandrel 312 from the lower end of the upper mandrel 312, as indicated by the arrow 336. Insertion from the lower end of the upper mandrel 312 permits the upper packer ring 314 to be fixedly coupled with the external coupling means of the upper mandrel 312 and the lower packer ring 316 to be slidably connected with (i.e., disposed around) the upper mandrel 312. Insertion from an upper end of the upper mandrel 312, as indicated by the arrow 338, is not possible because the inner opening of the lower packer ring 316 is sized to closely match the outer profile 313 of the upper mandrel 312 and will not pass the external coupling means of the upper mandrel 312. Accordingly, diameter 340 of the lower coupler 332 is limited to smallest diameter of the axial openings of the upper packer ring 314, the lower packer ring 316, and the inflatable packer 318 and, thus, the diameter 340 has to be substantially equal to or smaller than diameter 342 of the outer profile 313. The limited diameter 340 of the lower coupler 332 also limits diameter 344 of the upper coupler 334, limiting axial strength of the coupling joint 330 and, thus, maximum pressure differential between fluid pressure within the isolated interval and hydrostatic wellbore pressure external to the isolated interval that the dual-packer assembly 300 can safely withstand.

The dual-packer assembly 300 further comprises or is coupled with a lower (i.e., downhole) portion 348 of the tool string, which may be coupled with or below the lower mandrel 322 of the lower packer tool 320. A fluid pump 350 is disposed within the lower portion 348. A flowline 352 extends axially within the mandrels 312, 322 and the lower portion 348. The flowline 352 is fluidly connected with the pump 350 and with the inflatable packers 318, 328, such as to permit the pump 350 to selectively inflate and/or deflate the inflatable packers 318, 328. Each mandrel 312, 322 comprises a fluid port 354, 356 (i.e., inflation/deflation port) fluidly connected with the flowline 352 and extending to an outer surface of each mandrel 312, 322 to fluidly connect the flowline 352 and, thus the pump 350, with an internal space or volume of each inflatable packer 318, 328. Each of the upper mandrel 312, the lower mandrel 322, and the lower portion 348 of the tool string comprises one or more corresponding flowline segments that are connected together to form the flowline 352 when the packer assembly 300 is assembled to fluidly connect the pump 350 with the inflatable packers 318, 328.

During downhole operations (e.g., fluid sampling operations), the pump 350 may pump (i.e., discharge) a fluid (e.g., an inflation fluid) into the inflatable packers 318, 328 via the flowline 352 and the ports 354, 356 to expand the packers 318, 328 away from the corresponding mandrels 312, 322 to against the sidewall of the wellbore. The pump 350 may also pump (i.e., draw) the fluid out of the packers 318, 328 via the flowline 352 and the ports 354, 356 to retract the packers 318, 328 away from the sidewall of the wellbore toward and into contact with the corresponding mandrels 312, 322.

Figure 4:
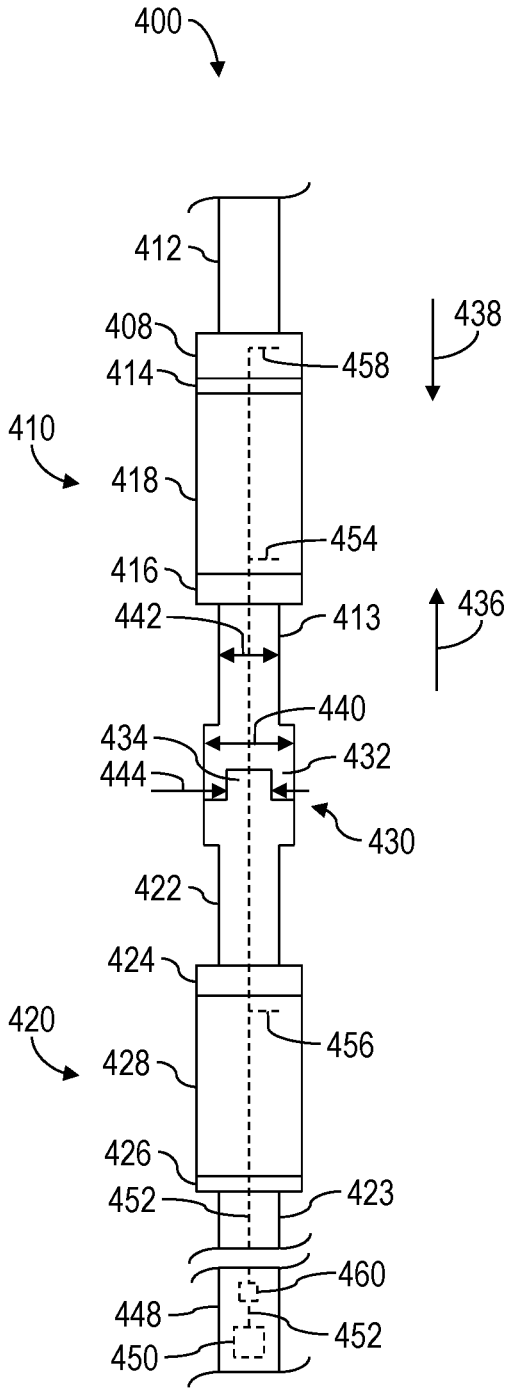
FIG. 4 is a schematic view of at least a portion of an example implementation of apparatus according to one or more aspects of the present disclosure.

FIG. 4 is a schematic view of at least a portion of an example implementation of an inflatable dual-packer tool 400 configured to be conveyed within a wellbore according to one or more aspects of the present disclosure. The dual-packer tool 400 may be conveyed within a wellbore as part of a tool string, such as the BHA 140 shown in FIG. 1, the tool string 204 shown in FIG. 2, and/or other tool strings within the scope of the present disclosure. The dual-packer tool 400 may be implemented as one or more of the LWD modules 144 or MWD modules 146 shown in FIG. 1, and/or one or more of the modules 212 shown in FIG. 2, and may thus be conveyed within the wellbore 104 via a wireline, a slickline, a drillstring, coiled tubing, completion tubing, a liner, a casing, and/or other conveyance means. As described below, the dual-packer tool 400 is an assembly of a plurality of components operating together in a coordinated manner and, thus, may also be referred to as a packer assembly.

The dual-packer tool 400 comprises an upper packer tool 410 having an upper mandrel 412, a lower packer ring 416 fixedly connected with the upper mandrel 412, and an upper packer ring 414 slidably connected to and, thus, axially movable with respect to the upper mandrel 412. The lower packer ring 416 may be fixedly connected with the upper mandrel 412 via an external coupling means (e.g., threads, shoulder, ring, etc.) (not shown) along an outer profile 413 (e.g., surface) of the upper mandrel 412. An upper inflatable (e.g., flexible, elastic) packer 418 (i.e., packer element) operable to expand against a sidewall of the wellbore may be sealingly connected with the upper and lower packer rings 414, 416. The upper packer ring 414, the lower packer ring 416, and the upper inflatable packer 418 may each comprise an axial opening or bore (not shown) configured to accommodate the upper mandrel 412 therethrough. Accordingly, the upper packer ring 414, the lower packer ring 416, and the upper inflatable packer 418 may each be disposed around the outer profile 413 of the upper mandrel 412.

The dual-packer tool 400 further comprises a latching mechanism 408 selectively operable to limit the axial movement of the upper packer ring 414 with respect to the upper mandrel 412 and permit the axial movement of the upper packer ring 414 with respect to the upper mandrel 412. For example, the latching mechanism 408 may be selectively operable to connect the upper packer ring 414 with the upper mandrel 412 to limit the axial movement of the upper packer ring 414 with respect to the upper mandrel 412 and disconnect the upper packer ring 414 from the upper mandrel 412 to permit the axial movement of the upper packer ring 414 with respect to the upper mandrel 412. Selectivity in the operation of the latching mechanism 408 may be associated with the unlatching function where a minimum amount of inflate pressure in an inflate flowline is utilized to energize the latching mechanism 408 to the unlatched configuration. The upper packer ring 414 may be in the latched configuration when no pressure is applied and, thus, operate as a fail proof feature permitting the dual-packer tool 400 to be pulled out of the wellbore when, for example, power is lost downhole.

The dual-packer tool 400 also comprises a lower packer tool 420 having a lower mandrel 422, an upper packer ring 424 fixedly connected with the lower mandrel 422, and a lower packer ring 426 slidably connected to and, thus, axially movable with respect to the lower mandrel 422. The lower packer ring 424 may be fixedly connected with the lower mandrel 422 via an external coupling means (not shown) along an outer profile 423 of the lower mandrel 422. A lower inflatable packer 428 operable to expand against the sidewall of the wellbore may be sealingly connected with the upper and lower packer rings 424, 426. The upper packer ring 424, the lower packer ring 426, and the lower inflatable packer 428 may each comprise an axial opening or bore (not shown) configured to accommodate the lower mandrel 422 therethrough. Accordingly, the upper packer ring 424, the lower packer ring 426, and the lower inflatable packer 428 may beach be disposed around the outer profile 423 of the lower mandrel 422.

In a deflated (i.e., retracted) state of each packer 418, 428, an inner surface of each packer 418, 428 may be disposed against and/or in contact with the outer profile 413, 423 of the corresponding mandrel 412, 422. In an inflated (i.e., expanded) state of each packer 418, 428, the inner surface of each packer 418, 428 may be disposed away from the outer profile 413, 423 of the corresponding mandrel 412, 422 and an outer surface of each packer 418, 428 may be disposed against the sidewall of the wellbore to fluidly isolate an interval of the wellbore extending between the upper and lower packers 418, 428 and/or to maintain the dual-packer tool 400 in position within the wellbore. The slidable connection between the upper packer ring 414 and the corresponding mandrel 412 permits the upper packer ring 414 to slide axially along the corresponding mandrel 412 in a downward direction, as indicated by arrow 438 when the packer 418 is being inflated, wherein the slidable connection between the lower packer ring 426 and the corresponding mandrel 422 permits the lower packer ring 426 to slide axially along the corresponding mandrel 422 in an upward direction, as indicated by arrow 436, when the packer 428 is being inflated. The slidable connection also permits the packer rings 414, 426 to slide axially in the opposing directions when the packers 418, 428 are being deflated.

The upper and lower mandrels 412, 422 may be coupled together at a coupling joint 430. For example, a lower end of the upper mandrel 412 may comprise a lower coupler 432 and an upper end of the lower mandrel 422 may comprise an upper coupler 434. The lower and upper couplers 432, 434 may be configured to engage each other to couple together the upper and lower mandrels 412, 422 and, thus, couple together the upper and lower packer tools 410, 420. In an example implementation, the lower coupler 432 may be or comprise a box connector and the upper coupler 434 may be or comprise a pin connector.

During assembly of the upper packer tool 410, an upper packer subassembly comprising the upper packer ring 414, the upper inflatable packer 418, and the lower packer ring 416 may be inserted onto the outer profile 413 of the upper mandrel 412 from the upper end of the upper mandrel 412, as indicated by the arrow 438. Furthermore, the upper packer subassembly may be inserted onto the outer profile 413 of the upper mandrel 412 with the fixed packer ring 416 directed (i.e., oriented) downwardly and the slidable ring 414 directed upwardly. Thus, unlike with the upper packer subassembly of the dual-packer tool 300, the sliding ring 414, which may be sized to closely match the outer profile 413 of the upper mandrel 412, will not have to pass the external coupling means of the upper mandrel 412 to be mounted on the mandrel 412. Accordingly, insertion from the upper end of the upper mandrel 412 permits the lower packer ring 416 to be fixedly coupled with the external coupling means of the upper mandrel 412 and the upper packer ring 414 to be slidably connected with (i.e., disposed around) the upper mandrel 412. Similarly, a lower packer subassembly comprising the upper packer ring 424, the lower inflatable packer 428, and the lower packer ring 426 may be inserted onto the outer profile 423 of the lower mandrel 412 from a lower end of the lower mandrel 422, as indicated by the arrow 436, and with the fixed packer ring 424 directed upwardly.

Because the upper packer subassembly is insertable onto the upper mandrel 412 from the upper end of the upper mandrel 412 and the lower packer subassembly is insertable onto the lower mandrel 422 from the lower end of the lower mandrel 422, the size of the lower and upper couplers 432, 434 may not be limited by diameters of the axial openings of the upper packer ring 424, the lower packer ring 426, and the lower inflatable packer 428. Accordingly, diameter 440 of the lower coupler 432 may be substantially larger than diameter 442 of the outer profile 413. The larger diameter 440 of the lower coupler 432 permits a larger diameter 444 of the upper coupler 434. The larger couplers 432, 434 increase axial strength of the coupling joint 430 and, thus, maximum pressure differential between fluid pressure within the isolated interval and hydrostatic wellbore pressure external to the isolated interval that the dual-packer assembly 400 can safely withstand. Furthermore, because the sliding rings 414, 426 and the inflatable packers 418, 428 do not have to pass over or around the external coupling means of the upper and lower mandrels 412, 422 during assembly, the external coupling means may also be physically larger and, thus, stronger, such as to increase the maximum pressure differential.

The dual-packer assembly 400 may further comprise or be coupled with a lower (i.e., downhole) portion 448 of the tool string, which may be coupled with or below the lower mandrel 422 of the lower packer tool 420. A fluid pump 450 may be disposed within the lower portion 448 and a flowline 452 may extend axially within the mandrels 412, 422 and the lower portion 448. The flowline 452 may be fluidly connected with the pump 450 and with the inflatable packers 418, 428, such as may permit the pump 450 to selectively inflate and/or deflate the inflatable packers 418, 428. Each mandrel 412, 422 may comprise a fluid port 454, 456 (i.e., an inflation/deflation port) fluidly connected with the flowline 452 and extending to an outer surface (i.e., outer profile 413, 423) of each mandrel 412, 422 to fluidly connect the flowline 452 and, thus the pump 450, with an internal space or volume of each of the inflatable packer 418, 428. The upper mandrel 412 may further comprise fluid port 458 fluidly connected with the flowline 452 and extending to the outer surface of the upper mandrel 412 to fluidly connect the flowline 452 and, thus the pump 450, with the latching mechanism 408. The flowline 452 may comprise a plurality of flowline segments, each associated with a corresponding one of the upper mandrel 412, the lower mandrel 422, and the lower portion 448 of the tool string, which when coupled together, form the flowline 452.

During downhole operations (e.g., formation testing), the pump 450 may be operable to pump (i.e., discharge) a fluid (e.g., an inflation fluid) into the inflatable packers 418, 428 via the flowline 452 and the ports 454, 456 to expand the packers 418, 428 away from the corresponding mandrels 412, 422 to against the sidewall of the wellbore. The fluid pumped by the pump 450 may also be directed to the latching mechanism 408 via the flowline 452 and the port 458 to operate (i.e., actuate) the latching mechanism 408. For example, in its normal (i.e., not actuated) state, the latching mechanism 408 may limit the downward axial movement of the upper packer ring 414 with respect to the upper mandrel 412 and when operated (i.e., actuated) by the fluid, the latching mechanism 408 may permit the downward axial movement of the upper packer ring 414 with respect to the upper mandrel 412. Accordingly, the pump 450 may be operable to simultaneously inflate the packers 418, 428 and actuate the latching mechanism 408 to permit the axial movement of the upper packer ring 414 while the packers 418, 428 are being inflated.

The pump 450 may be further operable to pump (i.e., draw) the fluid out of the packers 418, 428 via the flowline 452 and the ports 454, 456 to retract the packers 418, 428 away from the sidewall of the wellbore toward and into contact with the corresponding mandrels 412, 422. The pump 450 may also pump the fluid out of or away from the latching mechanism 408 via the flowline 452 and the port 458 to permit the latching mechanism 408 to return to its normal state in which the latching mechanism 408 limits the downward axial movement of the upper packer ring 414 with respect to the upper mandrel 412. However, instead of utilizing the pump 450 to transfer the fluid from the packers 418, 428 and/or the latching mechanism 408, a fluid valve 460 (e.g., fluid relief valve) may be opened to permit the fluid to flow out of the packers 418, 428 and/or the latching mechanism 408. For example, pressure differential between hydrostatic wellbore pressure external to the packers 418, 428 and fluid pressure inside the inflatable packers 418, 428 may cause the fluid to be evacuated out of the packers 418, 428 via the fluid valve 460. The packer tool 500 may also or instead comprise an automatic retraction mechanism (ARM) (not shown) operably connected with and operable to move (e.g., slide) the upper packer ring 414 in the upward axial direction to stretch and, thus, retract the packer 418 sufficiently to permit the latching mechanism 408 to its normal (i.e., locked) state.

FIGS. 5-9 are side sectional views of a portion of an example implementation of a packer tool 500 during different stages of operation according to one or more aspects of the present disclosure. The packer tool 500 may be conveyed within a wellbore as part of a tool string, such as the BHA 140 shown in FIG. 1, the tool string 204 shown in FIG. 2, and/or other tool strings within the scope of the present disclosure. The packer tool 500 may be or comprise an example implementation of one or more of the LWD modules 144 or MWD modules 146 shown in FIG. 1, one or more of the modules 212 shown in FIG. 2, and/or the dual-packer tool 400 shown in FIG. 4, and may thus comprise one or more features and/or modes of operation described above in association with the modules 144, 146, 212 and the dual-packer tool 400. As described below, the packer tool 500 is an assembly of a plurality of components operating together in a coordinated manner and, thus, may also be referred to as a packer assembly.

The packer tool 500 comprises a mandrel 512, a lower packer ring (not shown) fixedly connected with the mandrel 512, and an upper packer ring (not shown) slidably connected to and, thus, axially movable with respect to the mandrel 512. An inflatable (e.g., flexible, elastic) packer (i.e., packer element) (not shown) operable to expand against a sidewall of the wellbore may be sealingly connected with the upper and lower packer rings. The upper packer ring, the lower packer ring, and the inflatable packer may be installed or otherwise disposed around an outer profile 518, including one or more outer surfaces, of the mandrel 512. A flowline 514 (e.g., a fluid passage) may extend axially within the mandrel 512. The flowline 514 may be fluidly connected with a pump (not shown) located in another portion of the tool string. The mandrel 512 may comprise a fluid port (not shown) fluidly connected with the flowline 514 and with an internal space or volume of the inflatable packer. Accordingly, an inflation fluid (e.g., hydraulic fluid, oil) may be transferred via the flowline 514 to inflate and deflate the inflatable packer. The mandrel 512 may further comprise a fluid port 516 fluidly connected with the flowline 514 and extending to the outer surface (i.e., outer profile 518) of the mandrel 512. The mandrel 512 may also comprise one or more passages 519 extending longitudinally within the mandrel 512. The passage 519 may be configured to transfer a fluid between opposing ends of the mandrel 512.

The packer tool 500 may be or comprise a dual-packer tool, wherein the mandrel 512 is an upper mandrel and the packer is an upper packer. The packer tool 500 may thus further comprise a lower mandrel (not shown) coupled with the upper mandrel and a lower packer (not shown) sealingly connected with the lower mandrel via corresponding upper and lower packer rings (not shown). Similarly to the upper packer, the lower packer may be selectively operable to expand against the sidewall of the wellbore.

The packer tool 500 further comprises a latching mechanism 520 selectively operable to limit the axial movement of the slidable upper packer ring with respect to the mandrel 512 and permit the axial movement of the upper packer ring with respect to the mandrel 512. For example, the latching mechanism 520 may be selectively operable to connect the upper packer ring with the mandrel 512 to limit the axial movement of the upper packer ring with respect to the mandrel 512 and disconnect the upper packer ring from the mandrel 512 to permit the axial movement of the upper packer ring with respect to the mandrel 512.

Figure 5:
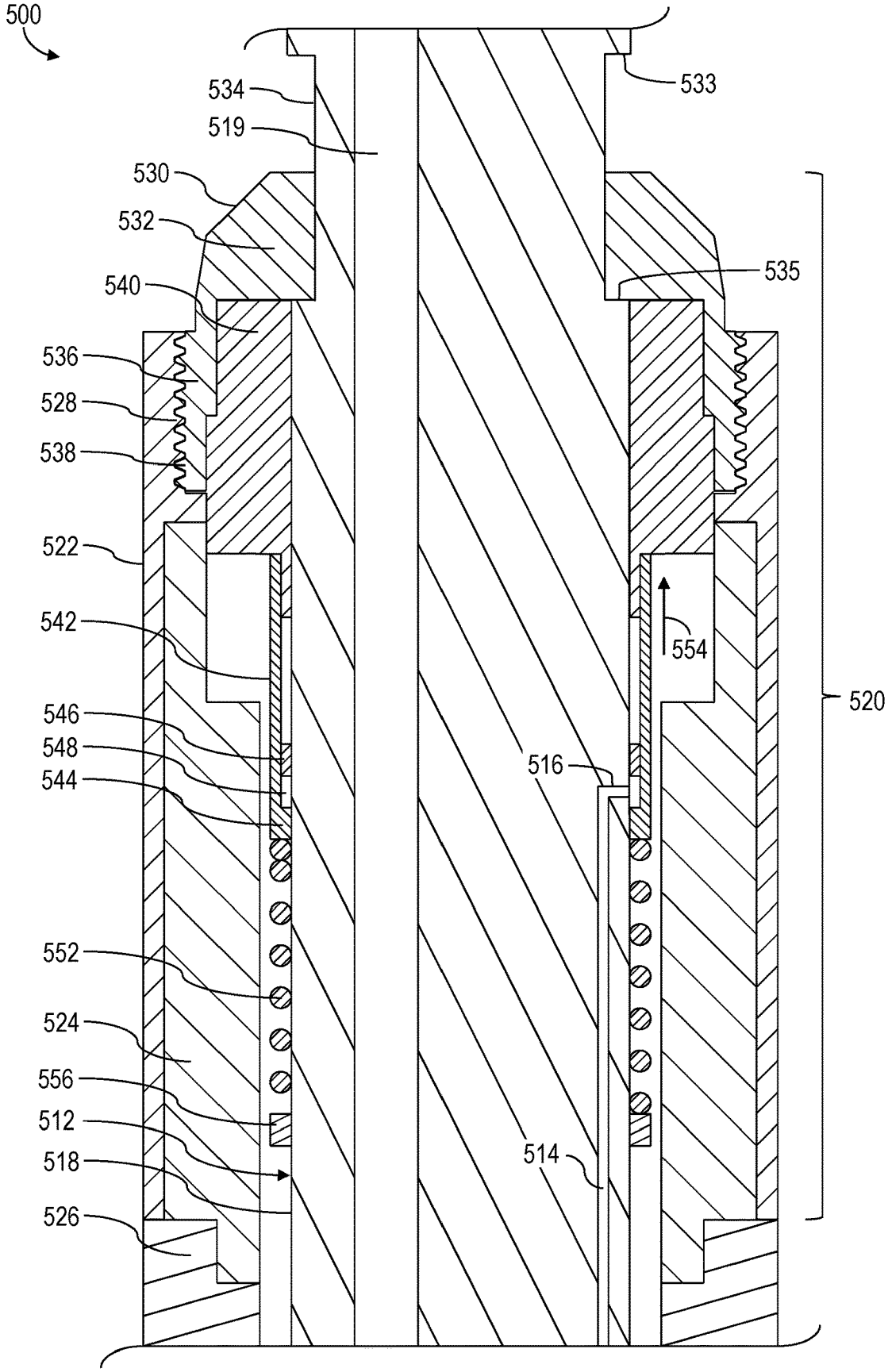
FIG. 5 is a sectional view of a portion of an example implementation of apparatus according to one or more aspects of the present disclosure.

The latching mechanism 520 may comprise a collar or sleeve 522 disposed around the mandrel 512. The sleeve 522 may be coupled directly with the upper packer ring or indirectly via one or more intermediate collars, sleeves, or other member 524, 526 connected between the sleeve 522 and the upper packer ring. One or both of the members 524, 526 may be or form at least a portion of the ARM described above. The sleeve 522 may be a ratchet sleeve, wherein at least a portion of the sleeve 522 comprises teeth, splines, castellations, alternating slots and protrusions, or another profile 528. The latching mechanism 520 may further comprise a collet 530 disposed around and connected with the mandrel 512. The collet 530 may comprise a base 532 slidably disposed within a channel 534 extending circumferentially around the mandrel 512, which permits the collet 530 limited axial movement with respect to the mandrel 512 between opposing upper and lower shoulders (i.e., ends) 533, 535 of the channel 534. The collet 530 may further comprise a plurality of elastically flexible fingers 536 extending from the base 532 and distributed circumferentially around the mandrel 512. The collet 530 may be a ratcheting collet, wherein each finger 536 comprises teeth, splines, castellations, alternating slots and protrusions, or other profiles 538 configured to engage (i.e., lock with) the profile 528 of the sleeve 522. When engaged together, as shown in FIG. 5, the profiles 528, 538 prevent the sleeve 522 from moving with respect to the collet 530 and, thus, prevent the slidable upper ring connected with the sleeve 522 from moving axially downwards with respect to the mandrel 512. Although the profile 528 of the sleeve 522 is shown as an internal (i.e., inwardly extending) profile and the profile 538 of the collet 530 is shown as an external (i.e., outwardly extending) profile, the sleeve 522 may be implemented as a collet connected with the upper packer ring and comprising fingers with external profiles and the collet 530 may be implemented as a sleeve connected with the mandrel 512 and comprising an internal profile.

Figure 6:
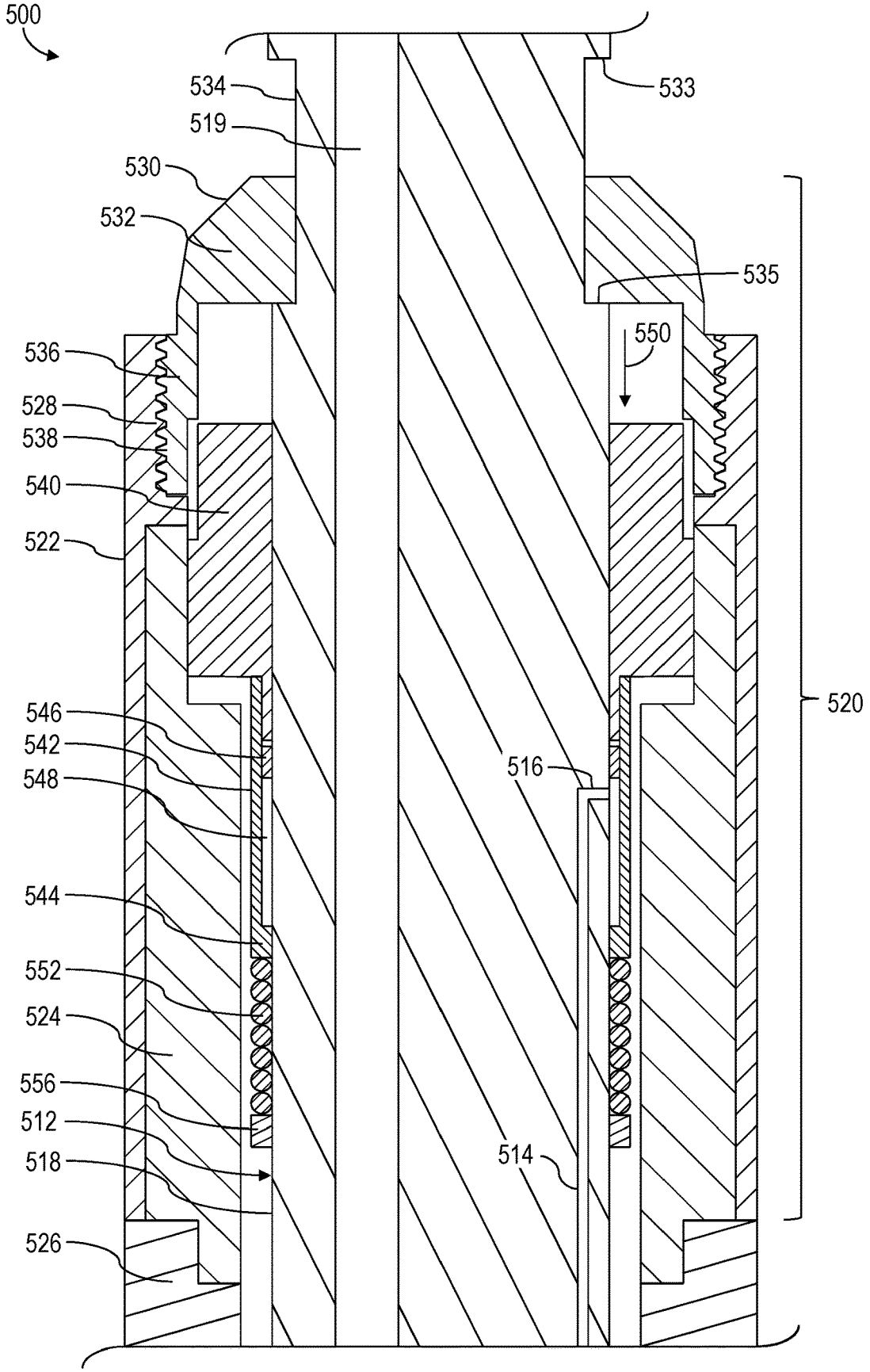
FIGS. 6-9 are sectional views of the apparatus shown in FIG. 5 at different stages of operation according to one or more aspects of the present disclosure.

The latching mechanism 520 may further comprise a latching ring, collar, or sleeve 540 disposed around the mandrel 512 and operable to move axially with respect to the mandrel 512 between a first position, in which the latching sleeve 540 prevents the profiles 528, 538 (and thus the sleeve 522 and collet 530) from disengaging, and a second position, in which the latching sleeve 540 permits the profiles 528, 538 (and thus the sleeve 522 and collet 530) to disengage. FIG. 5 shows the latching sleeve 540 in the first position with the latching sleeve 540 positioned between the fingers 536 and the mandrel 512 and disposed against an inner profile of the fingers 536, such as may prevent or otherwise limit radially inward movement (e.g., elastic bending) of the fingers 536 and the profile 538 to prevent the profiles 528, 538 from disengaging. FIG. 6 shows the latching sleeve 540 in the second position with the latching sleeve 540 at least partially removed from between the fingers 536 and the mandrel 512 and not disposed against the inner profile of the fingers 536, such as may permit the radially inward movement of the fingers 536 and the profile 538 to permit the profiles 528, 538 to disengage.

The latching mechanism 520 may also comprise an actuation sleeve 542 operable to move the latching sleeve 540 between the first and second positions. The actuation sleeve 542 may be slidably disposed around the mandrel 512 and connected with the latching sleeve 540. The actuation sleeve 542 may comprise a circumferential inwardly extending shoulder 544 slidably engaging the outer profile 518 of the mandrel 512. An inner profile of the actuation sleeve 542 may also slidably engage a circumferential outwardly extending shoulder 546 fixedly connected with or forming the outer profile 518 of the mandrel 512. Each shoulder 544, 546 may comprise a corresponding fluid seal (not shown), such as may permit the shoulders 544, 546 to sealingly engage the outer profile 518 of the mandrel 512 and the inner profile of the actuation sleeve 540, respectively, while the actuation sleeve 542 moves axially along the mandrel 512. The actuation sleeve 542, the shoulders 544, 546, and the mandrel 512 may define an annular volume or space 548. The space 548 may be fluidly connected with the port 516 such as may permit the space 548 to receive and discharge the inflation fluid via the flowline 514. When the inflation fluid is pumped or otherwise introduced into the space 548, the space 548 expands causing (i.e., actuating) the actuation sleeve 542 to move downwards with respect to the mandrel 512 to move the latching sleeve 542 from the first position to the second position, as indicated by arrow 550.

A biasing member 552 (e.g., a spring) may be operatively connected with the actuation sleeve 542 and the mandrel 512 and operable to bias the actuation sleeve 542 from the second position toward the first position, as indicated by arrow 554. The biasing member 552 may be disposed around the mandrel 512, with one end of the biasing member 552 disposed against a shoulder 556 fixedly connected with the mandrel 512 and an opposing end of the biasing member 552 disposed against the actuation sleeve 542. Accordingly, the biasing member 552 may maintain the latching sleeve 540 in the first position and/or move the latching sleeve 540 from the second position to the first position when the inflation fluid is not being pumped into the space 548 via the flowline 514.

As described above, during downhole operation, the latching mechanism 408, 520 of the packer tools 400, 500 may be selectively operable to limit the downward axial movement of the slidable upper packer ring 414 with respect to the upper mandrel 412, 512 and permit the axial movement of the upper packer ring 414 with respect to the upper mandrel 412, 512. The following description describes the operation of the latching mechanism 408, 520 during a typical downhole operation.

Referring to FIGS. 4 and 5, when the dual-packer tool 400, 500 is conveyed downwards within a wellbore, the biasing member 552 may maintain the latching sleeve 540 in the first position, limiting downward axial movement of the upper packer ring 414 with respect to the mandrel 412, 512. If a portion of the upper packer 418 is caught against or otherwise contacts a sidewall of the wellbore, the upper packer ring 414 and portions of the latching mechanism 408, 520, such as the sleeve 522 and the collet 530, may move axially with respect to the mandrel 412, 512 in the upward direction, as indicated by arrow 436, perhaps stretching the packer 418 to permit the packer 418 to pass through the wellbore. However, such upward movement may be limited to a distance between the base 532 of the collet 530 and the upper shoulder 533 of the circumferential channel 534.

After the packer tool 400, 500 is conveyed within the wellbore to a predetermined location along the wellbore, the pump 450 may be operated to transfer the inflation fluid to the packers 418, 428 and the latching mechanism 408, 520 via the flowline 452, 514 and the corresponding ports 454, 456, 458, 516. The inflation fluid may simultaneously expand the inflatable packers 418, 428 away from the corresponding mandrels 412, 422, 512 against the sidewall of the wellbore and operate the latching mechanism 408, 520 to permit the axial movement of the upper packer ring 414 with respect to the corresponding mandrels 412, 422, 512. A sequencing valve (not shown) may be fluidly connected along the flowline 452, 514 to permit operation of the latching mechanism 408, 520 before expansion of the inflatable packers 418, 428. Furthermore, although a single flowline 452, 514 is shown fluidly connected with the latching mechanism 408, 520 and the inflatable packers 418, 428, the latching mechanism 408, 520 and the inflatable packers 418, 428 may each be fluidly connected with the pump 450 or another fluid source via separate (i.e., fluidly isolated) flowlines, such as may permit independent operation of the latching mechanism 408, 520 and inflation of the inflatable packers 418, 428. Accordingly, the packer tool 400, 500 may comprise a plurality of flowlines (e.g., a flowline system) fluidly connecting the pump 450 with the latching mechanism 408, 520 and the inflatable packers 418, 428 independently of each other.

As shown in FIGS. 4 and 6, the inflation fluid pumped into the space 548 actuates the actuating sleeve 542 in a downward direction, as indicated by the arrow 550, to move the latching sleeve 540 from the first position to the second position while compressing the biasing member 552. The expanding packers 418, 428 narrow (i.e., decrease) in height, pulling the upper packer ring 414 of the upper packer assembly 410 in the downward direction, as indicated by arrow 438, and the lower packer ring 426 of the lower packer assembly 420 in the upward direction, as indicated by arrow 436.

Figure 7:
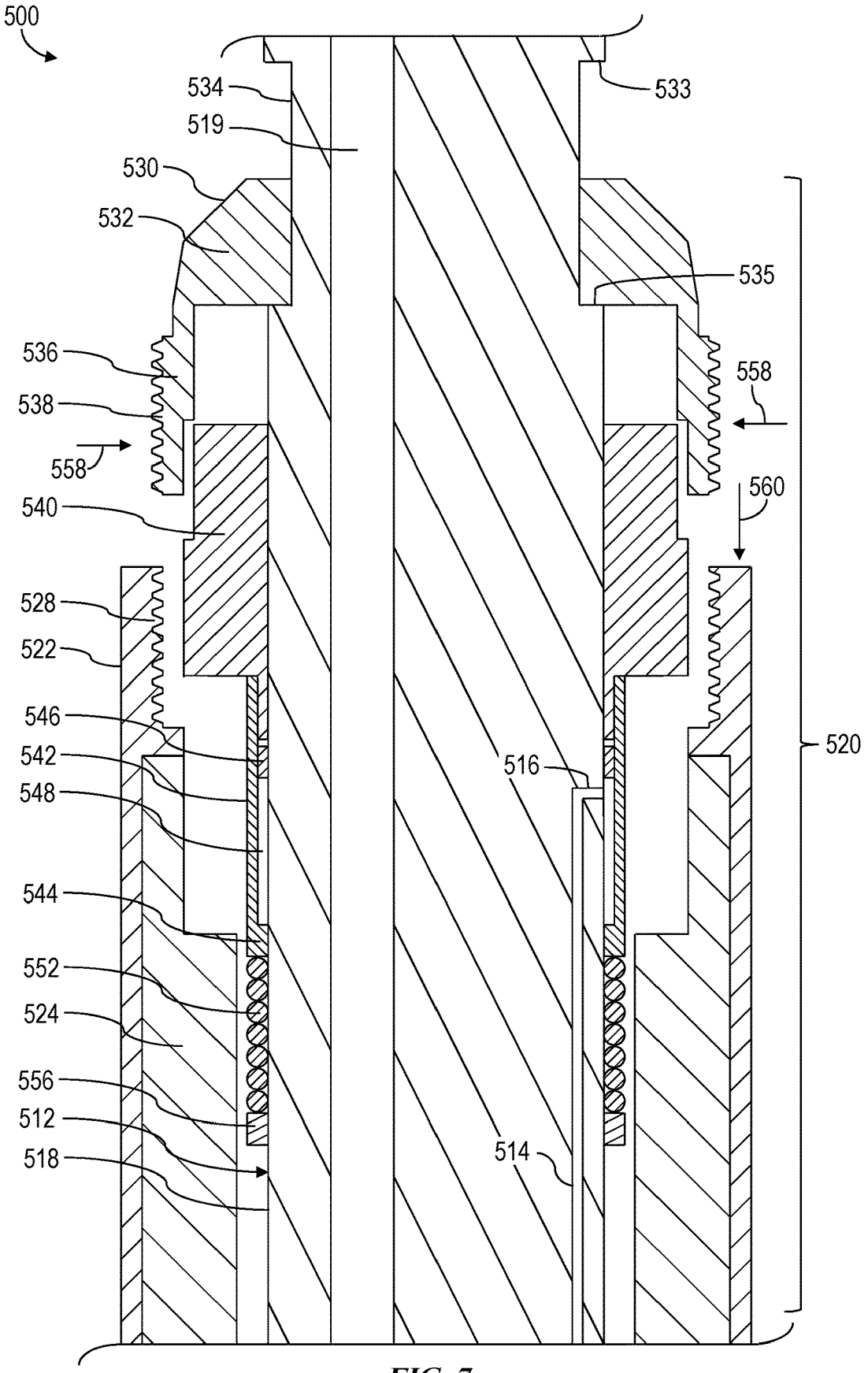

As shown in FIGS. 4 and 7, downward tension applied by the upper packer 418 to the upper packer ring 414 by the expanding upper packer 418 is transmitted to the sleeve 522 and the corresponding profile 528 causing the fingers 536 to elastically bend radially inwards, as indicated by arrows 558. Such bending of the fingers 536 permits the profiles 528, 538 to disengage and, thus, permits the sleeve 522 and the upper packer ring 414 to move axially with respect to the mandrel 512 in a downward direction, as indicated by arrow 560. When the upper and lower packers 418, 428 fully engage the sidewall, the downhole operations (e.g., formation evaluation) may commence. Because the lower packer ring 416 of the upper packer assembly 410 and the upper packer ring 424 of the lower packer assembly 420 are fixedly connected with the corresponding mandrels 412, 422, the volume of the isolated annular wellbore interval between the upper and lower packers 418, 428 may be maintained substantially constant during the subsequent downhole operations.

Figure 8:
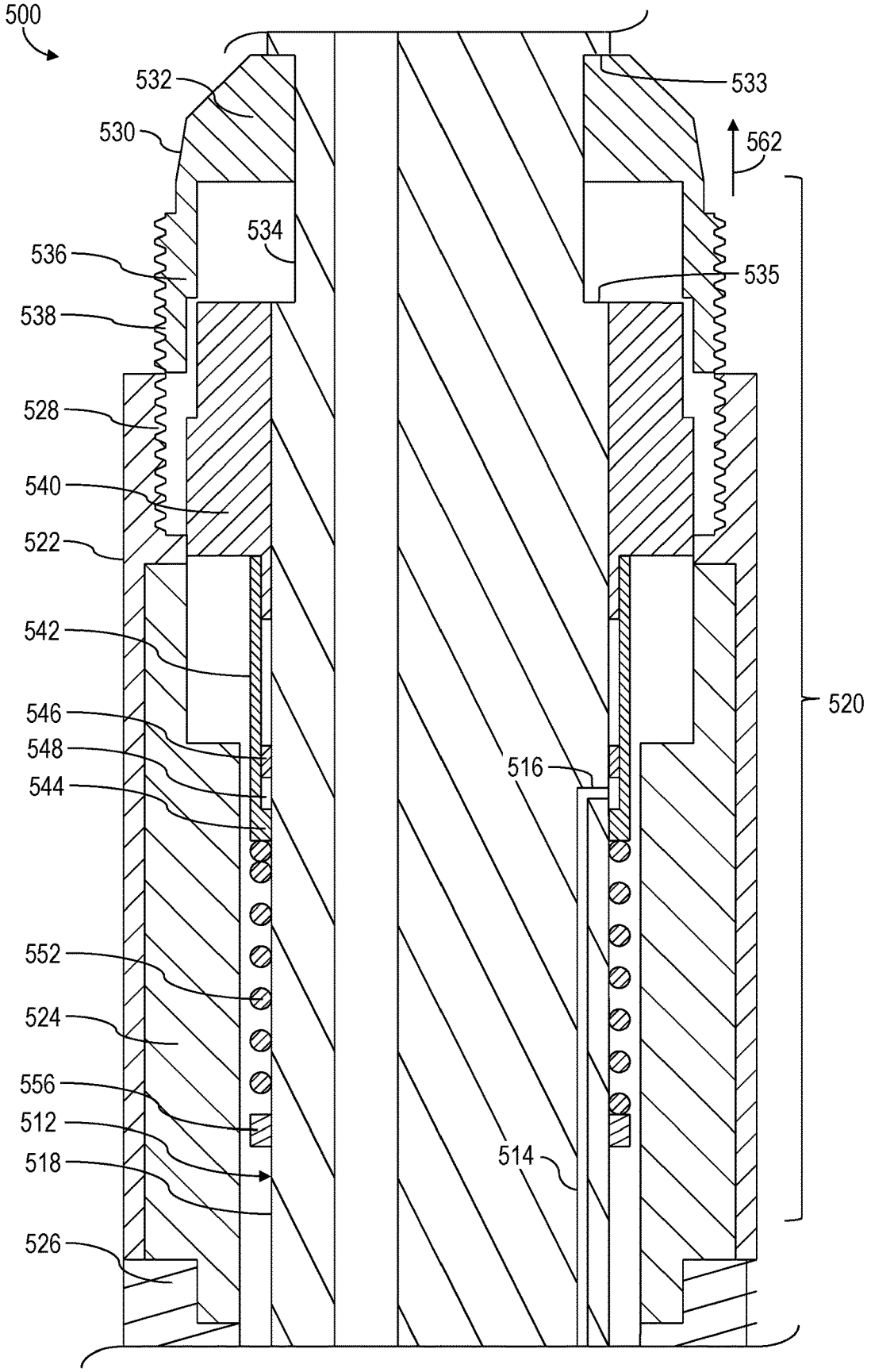

Referring now to FIGS. 4 and 8, when it is intended to convey the packer tool 400, 500 upwards, such as to move the packer tool 400, 500 to another location within the wellbore or to convey the packer tool 400, 500 to the wellsite surface after completing the downhole operations, the inflation fluid within the packers 418, 428 and the space 548 of the latching mechanism 408, 520 may be discharged via the flowline 452, 514 and the corresponding ports 454, 456, 458, 516. For example, the inflation fluid may be pumped out of the packers 418, 428 and the space 548 with the pump 450 or the inflation fluid may be relieved from the packers 418, 428 and the space 548 with the fluid valve 460 to retract the packers 418, 428. The biasing member 522 may then move the latching sleeve 540 to the first position and the packers 418, 428 may retract away from the sidewall toward the corresponding mandrels 412, 422, 512. The retracting packers 418, 428 may then increase in height, pushing the upper packer ring 414 of the upper packer assembly 410 and the sleeve 522 in the upward direction, as indicated by the arrow 436, and pushing the lower packer ring 426 of the lower packer assembly 420 in the downward direction, as indicated by the arrow 438. When the sleeve 522 contacts the fingers 536 of the collet 530, the sleeve 522 pushes the collet 530 in the upward direction, as indicated by the arrow 562, until the base 532 of the collet 530 contacts the upper shoulder 533 of the circumferential channel 534. In such position, the latching sleeve 540 is not disposed against the fingers 536, permitting the fingers 536 to bend radially inwards.

Figure 9:
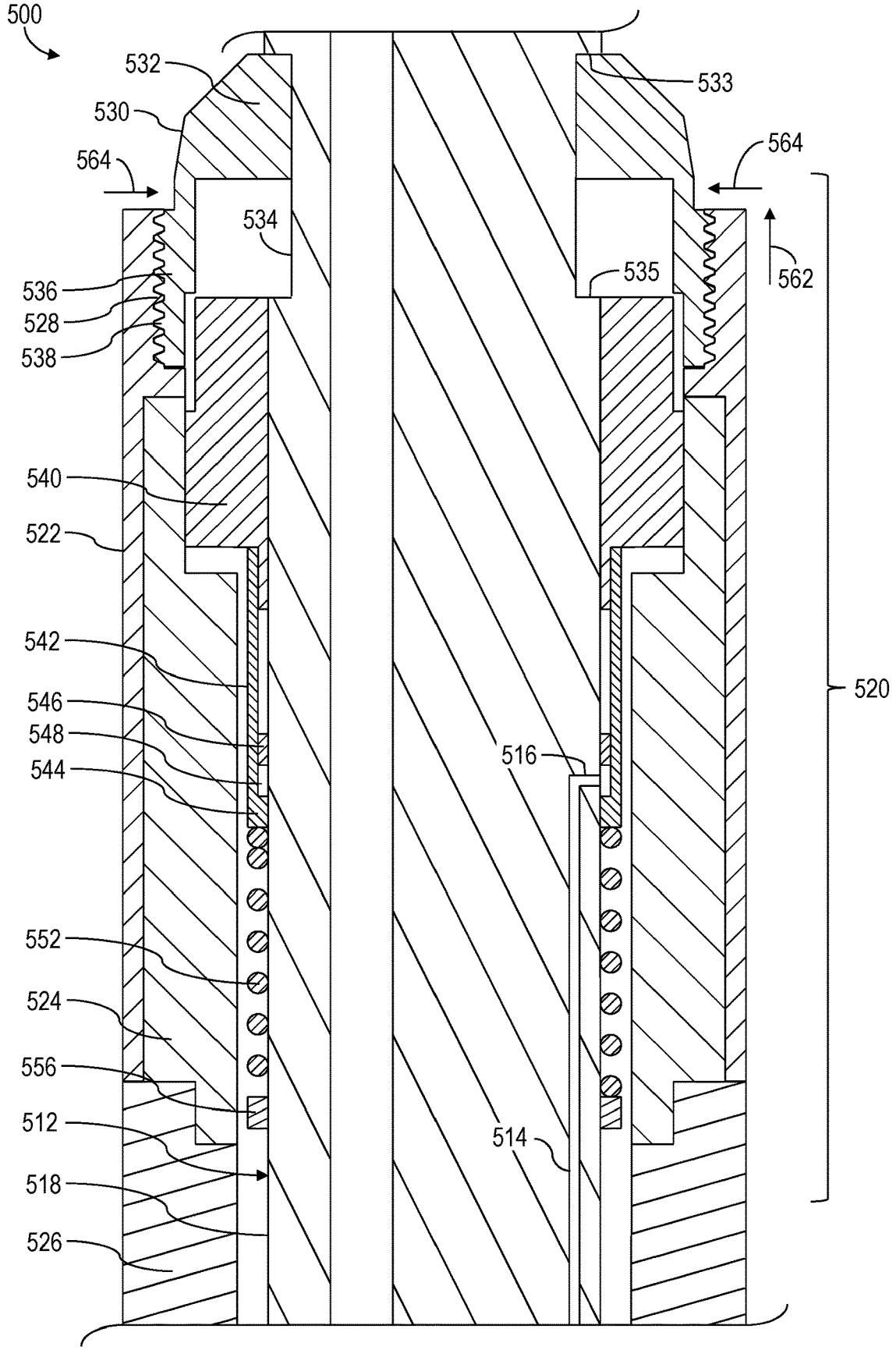

As shown in FIGS. 4 and 9, while the upper packer ring 414 and the sleeve 522 continue to move in the upward direction, as indicated by the arrow 562, the moving sleeve 522 forces the fingers 536 to bend radially inwards, as indicated by the arrow 564, causing the profiles 528, 538 to reengage. After the profiles 528, 538 fully reengage, the packer tool 400, 500 may be conveyed upwards along the wellbore while the biasing member 552 maintains the latching sleeve 540 in the first position.

During the upward conveyance, if a portion of the latching mechanism 408, 520 and/or the upper packer 418 is caught against an obstruction within the wellbore or otherwise contacts the sidewall of the wellbore, the upper packer ring 414 and portions of the latching mechanism 520, such as the sleeve 522 and the collet 530, may move in the downward direction with respect to the upper mandrel 512, as indicated by arrow 438, until the base 532 of the collet 530 contacts the lower shoulder 535 of the circumferential channel 534, preventing further downward movement of the collet 530, the sleeve 522, and the upper packer ring 414. In such position, shown in FIG. 5, the fingers 536 of the collet 530 are disposed against the latching sleeve 540, which prevents the fingers 536 from bending radially inwards and, thus, prevents the profiles 528, 538 from disengaging. Therefore, if a portion of the upper packer 418 is caught against an obstruction or otherwise contacts the sidewall of the wellbore during the upward conveyance, the upper packer ring 414 will not be permitted to slide downwards and permit the upper packer 418 to expand, which may cause the packer tool 400, 500 to become stuck within the wellbore. Because the upper packer 418 will not be permitted to expand, the packer tool 400, 500 may be pulled through the obstruction within the wellbore to be repositioned at a different depth or returned to the surface.

The present disclosure is also directed to one or more methods according to one or more aspects of the present disclosure. The methods described below and/or other operations described herein may be performed utilizing or otherwise in conjunction with at least a portion of one or more implementations of one or more instances of the apparatus shown in one or more of FIGS. 1, 2, and 4-9 and/or otherwise within the scope of the present disclosure. However, the methods and operations described herein may be performed in conjunction with implementations of apparatus other than those depicted in FIGS. 1, 2, and 4-9 that are also within the scope of the present disclosure. The methods and operations may be performed manually by one or more human operators, and/or may be performed or caused to be performed automatically by the apparatus described herein and/or by a processing device executing the coded instructions according to one or more aspects of the present disclosure. For example, the processing device may receive input signals and automatically generate and transmit output signals to operate or cause a change in an operational parameter of one or more pieces of the wellsite equipment described above. However, the human operator may also or instead manually operate the one or more pieces of wellsite equipment via the processing device based on sensor signals displayed.

Figure 10:
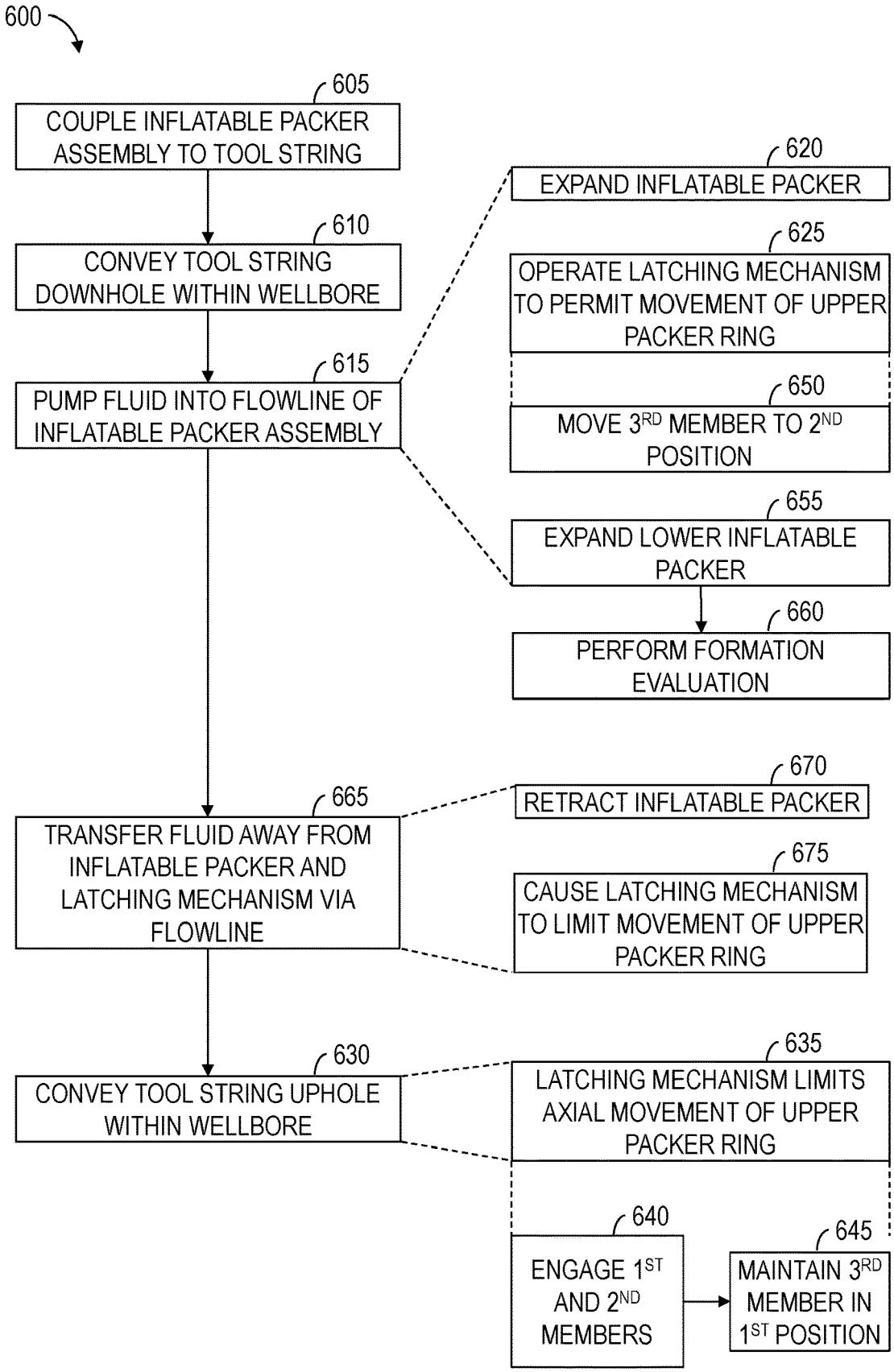
FIG. 10 is a flow-chart diagram of at least a portion of an example implementation of a method according to one or more aspects of the present disclosure.

FIG. 10 is a flow-chart diagram of at least a portion of an example implementation of a method (600) according to one or more aspects of the present disclosure. The method (600) may comprise coupling (605) an inflatable packer assembly 400, 500 to a tool string 140, 204. The inflatable packer assembly 400, 500 may comprise a mandrel 412, 512 comprising a flowline 452, 514 extending within the mandrel 412, 512, an upper packer ring 414 selectively axially movable with respect to the mandrel 412, 512, a lower packer ring 416 fixedly connected with the mandrel 412, 512, a latching mechanism 408, 520 fluidly connected with the flowline 452, 514, and an inflatable packer 418 disposed around the mandrel 412, 512 and sealingly connected with the upper and lower packer rings 414, 416. The inflatable packer 418 may be fluidly connected with the flowline 452, 514.

The method (600) may further comprise conveying (610) the tool string 140, 204 in a downhole direction within a wellbore. After the inflatable packer assembly 400, 500 is conveyed (610) within the wellbore, a fluid may be pumped (615) into the flowline 452, 514 to expand (620) the inflatable packer 418 away from the mandrel 412, 512 and against a sidewall of the wellbore and operate (625) the latching mechanism 408, 520 to permit the downward axial movement of the upper packer ring 414 with respect to the mandrel 412, 512. The mandrel 412, 512 may further comprise an upper port 458, 516 fluidly connecting the flowline 452, 514 with the latching mechanism 408, 520 and a lower port 454 fluidly connecting the flowline 452, 514 with the inflatable packer 418. Accordingly, pumping (615) the fluid into the flowline 452, 514 may transfer the fluid to the latching mechanism 408, 520 via the upper port 458, 516, and into the inflatable packer 418 via the lower port 454.

The method (600) may also comprise conveying (630) the tool string 140, 204 in an uphole direction within the wellbore while the latching mechanism 408, 520 is limiting (635) the downward axial movement of the upper packer ring 414 with respect to the mandrel 412, 512. Limiting (635) the downward axial movement of the upper packer ring 414 with respect to the mandrel 412, 512 may comprise connecting the upper packer ring 414 with the mandrel 412, 512 via the latching mechanism 408, 520. Furthermore, pumping (615) the fluid into the flowline 452, 514 may cause the latching mechanism 408, 520 to disconnect the upper packer ring 414 from the mandrel 412, 512 to permit the downward axial movement of the upper packer ring 414 with respect to the mandrel 412, 512.

The latching mechanism 408, 520 may comprise a first member 522 connected with the upper packer ring 414, a second member 530 connected with the mandrel 412, 512, and a third member 540. Thus, limiting (635) the downward axial movement of the upper packer ring 414 with respect to the mandrel 412, 512 may comprise engaging (640) the first and second members 522, 530 with each other to limit axial movement of the first member 522 with respect to the second member 530, and maintaining (645) the third member 540 in a first position in which at least a portion of the third member 540 prevents the first and second members 522, 530 from disengaging. Operating (625) the latching mechanism 408, 520 may comprise moving (650) the third member 540 to a second position in which at least a portion of the third member 540 permits the first and second members 522, 530 to disengage to permit the downward axial movement of the upper packer ring 414 with respect to the mandrel 412, 512. In the first position, at least a portion of the third member 540 may be disposed against the second member 530 to prevent the second member 530 from elastically bending to prevent the first and second members 522, 530 from disengaging, and in the second position, at least a portion of the third member 540 may not be disposed against the second member 530 to permit the second member 530 to elastically bend to permit the first and second members 522, 530 to disengage.

The first member 522 may comprise an internal profile 528 and the second member 530 may comprise an external profile 538. Thus, engaging (640) the first and second members 522, 530 with each other comprises engaging the first and second profiles 528, 538 with each other to limit axial movement of the first member 522 with respect to the second member 530, maintaining (645) the third member 540 in the first position may comprise maintaining the third member 540 disposed between the mandrel 412, 512 and the second member 530 to limit radially inward movement of the second member 530 to prevent the internal and external profiles 528, 538 from disengaging, and operating (625) the latching mechanism 408, 520 to move the third member 540 to the second position may comprise operating the latching mechanism 408, 520 to move at least a portion of the third member 540 such that the third member 540 is not disposed between the mandrel 412, 512 and the second member 530 to permit the radially inward movement of the second member 530 to permit the internal and external profiles 528, 538 to disengage. Maintaining (645) the third member 540 in the first position may further comprise biasing the third member 540 toward the first position via a biasing member 552.

The third member 540 may comprise a latching sleeve 540 and an actuation sleeve 542. The latching sleeve 540 may be disposed around the mandrel 412, 512 and configured to prevent the first and second members 522, 530 from disengaging when in the first position and permit the first and second members 522, 530 to disengage when in the second position. The actuation sleeve 542 may be disposed around the mandrel 412, 512 and connected with the latching sleeve 540. The actuation sleeve 542 may define an annular space 548 between the actuation sleeve 542 and the mandrel 412, 512, and the flowline 452, 514 may be fluidly connected with the annular space 548. Accordingly, pumping (615) the fluid into the flowline 452, 514 may transfer the fluid into the annular space 548 causing the actuation sleeve 542 to move axially with respect to the mandrel 412, 512 to axially move the latching sleeve 540 from the first position to the second position.

The inflatable packer assembly 400, 500 may be an inflatable dual-packer assembly, wherein the inflatable packer 418 is an upper inflatable packer 418 and the inflatable packer assembly 400, 500 further comprises a lower inflatable packer 428. Thus, pumping (615) the fluid into the flowline 452, 514 also expands (655) the lower inflatable packer 428 to isolate a section of the wellbore between the upper and lower inflatable packers 418, 428, and the method (600) may further comprise, after conveying the tool string 140, 204 in the downhole direction within the wellbore and before conveying the tool string 140, 204 in the uphole direction within the wellbore, performing (660) formation evaluation operation within the isolated section.

After conveying (610) the tool string 140, 204 in the downhole direction within the wellbore and before conveying (630) the tool string 140, 204 in the uphole direction within the wellbore, the method (600) may further comprise transferring (665) the fluid away from the inflatable packer 418 and the latching mechanism 408, 520 via the flowline 452, 514 to retract (670) the inflatable packer 418 toward the mandrel 412, 512 away from the sidewall of the wellbore, and cause (675) the latching mechanism 408, 520 to limit the downward axial movement of the upper packer ring 414 with respect to the mandrel 412, 512. Transferring (665) the fluid away from the inflatable packer 418 via the flowline 452, 514 to retract the inflatable packer 418 may be caused by operating a fluid valve 460 to permit the fluid within the inflatable packer 418 to flow out of the inflatable packer 418 in response to pressure differential between hydrostatic wellbore pressure external to the inflatable packer 418 and fluid pressure inside the inflatable packer 418.

In view of the entirety of the present application, including the figures and the claims, a person having ordinary skill in the art will readily recognize that the present disclosure introduces an apparatus comprising a dual packer assembly for conveyance within a wellbore, wherein the dual packer assembly comprises: (A) an upper packer assembly comprising: (1) an upper mandrel; (2) a first upper packer ring axially movable with respect to the upper mandrel; (3) a first lower packer ring fixedly connected with the upper mandrel; and (4) an upper inflatable packer disposed around the upper mandrel and sealingly connected with the first upper and first lower packer rings, wherein the upper inflatable packer is operable to expand against a sidewall of the wellbore; and (B) a lower packer assembly comprising: (1) a lower mandrel coupled with the upper mandrel; (2) a second upper packer ring fixedly connected with the lower mandrel; (3) a second lower packer ring axially movable with respect to the lower mandrel; and (4) a lower inflatable packer disposed around the lower mandrel and sealingly connected with the second upper and second lower packer rings, wherein the lower inflatable packer is operable to expand against the sidewall of the wellbore, and wherein the upper and lower inflatable packers are collectively operable to isolate a section of the wellbore when expanded.

The upper packer assembly may further comprise a latching mechanism selectively operable to: limit the axial movement of the first upper packer ring with respect to the upper mandrel; and permit the axial movement of the first upper packer ring with respect to the upper mandrel. In such implementations, among others within the scope of the present disclosure, the latching mechanism may be selectively operable to: connect the first upper packer ring with the upper mandrel to limit the axial movement of the first upper packer ring with respect to the upper mandrel; and disconnect the first upper packer ring from the upper mandrel to permit the axial movement of the first upper packer ring with respect to the upper mandrel. The dual packer assembly may further comprise a flowline extending within the upper and lower mandrels, wherein the flowline may be fluidly connected with the latching mechanism, and wherein the latching mechanism may be operable to permit the axial movement of the first upper packer ring with respect to the upper mandrel upon being actuated by a fluid from the flowline. The flowline may be fluidly connected with the upper and lower inflatable packers, the upper and lower inflatable packers may be operable to expand against the sidewall of the wellbore upon receiving the fluid from the flowline, and the latching mechanism may be operable to permit the axial movement of the first upper packer ring with respect to the upper mandrel while the upper and lower inflatable packers are being expanded against the sidewall of the wellbore.

The upper mandrel may comprise a first outer profile having a first diameter. The first upper packer ring, the first lower packer ring, and the upper inflatable packer may be disposed about the first outer profile. The upper mandrel may further comprise a lower coupler coupled with an upper coupler of the lower mandrel. The lower coupler may have a second diameter that is substantially greater than the first diameter. The lower coupler may be a box connector, and the upper coupler may be a pin connector. The lower coupler may be at a lower end of the upper mandrel opposite an upper end of the upper mandrel, and the upper mandrel may be configured to receive thereon the first upper packer ring, the first lower packer ring, and the upper inflatable packer at the upper end of the mandrel during assembly of the dual packer assembly.

The present disclosure also introduces an apparatus comprising an inflatable packer assembly configured to be conveyed within a wellbore, wherein the inflatable packer assembly comprises: (A) a mandrel comprising a flowline; (B) a first packer ring slidably connected with the mandrel; (C) a second packer ring fixedly connected with the mandrel; (D) a latching mechanism fluidly connected with the flowline, wherein the latching mechanism is operable to: (1) limit movement of the first packer ring with respect to the mandrel; and (2) permit the movement of the first packer ring with respect to the mandrel upon being actuated by a fluid from the flowline; and (E) an inflatable packer disposed around the mandrel and sealingly connected with the first and second packer rings, wherein the inflatable packer is fluidly connected with the flowline, and wherein the inflatable packer is operable to expand against a sidewall of the wellbore upon receiving the fluid from the flowline.

The first packer ring may be an upper packer ring and the second packer ring may be a lower packer ring. The inflatable packer assembly may be an upper packer assembly, the mandrel may be an upper mandrel, the inflatable packer may be an upper packer, and the apparatus may further comprise a lower packer assembly comprising: a lower mandrel coupled with the upper mandrel; and a lower packer disposed around the lower mandrel and operable to expand against the sidewall of the wellbore, wherein the upper and lower packers are collectively operable to isolate a section of the wellbore when expanded.

The flowline may extend longitudinally within the mandrel, and the mandrel may further comprise: a first port fluidly extending to an outer surface of the mandrel and fluidly connecting the flowline with the latching mechanism; and a second port fluidly extending to the outer surface of the mandrel and fluidly connecting the flowline with the inflatable packer.

The fluid transmitted via the flowline may expand the inflatable packer, and may operate the latching mechanism to permit the movement of the first packer ring with respect to the mandrel.

The latching mechanism may be operable to: connect the first packer ring with the mandrel to limit the movement of the first packer ring with respect to the mandrel; and upon being actuated by the fluid from the flowline, disconnect the first packer ring from the mandrel to permit the movement of the first packer ring with respect to the mandrel.

The latching mechanism may comprise a first member connected with the first packer ring, a second member connected with the mandrel, and a third member. The first and second members may be operable to engage each other to limit the movement of the first member with respect to the second member to limit the movement of the first packer ring with respect to the mandrel. The third member may be operable to, upon being actuated by the fluid from the flowline, move from a first position in which at least a portion of the third member prevents the first and second members from disengaging to a second position in which the at least a portion of the third member permits the first and second members to disengage to permit the movement of the first packer ring with respect to the mandrel. For example, in the first position, the at least a portion of the third member may be disposed against the second member to prevent the second member from elastically bending to prevent the first and second members from disengaging, and in the second position, the at least a portion of the third member may not be disposed against the second member to permit the first member to elastically bend to permit the first and second members to disengage. In an example implementation, the first member may comprise an internal profile, the second member may comprise an external profile, the internal and external profiles may be configured to engage to limit the movement of the first member with respect to the second member, and: in the first position, the at least a portion of the third member may be disposed between the mandrel and the second member to limit radially inward movement of the second member to prevent the internal and external profiles from disengaging; and in the second position, the at least a portion of the third member may not be disposed between the mandrel and the second member to permit the radially inward movement of the second member to permit the internal and external profiles to disengage. In an example implementation: the first member may be or comprise a sleeve disposed around the mandrel and having a first profile; the second member may be or comprise a collet disposed around the mandrel and having a second profile; the first and second profiles may be configured to engage to limit the movement of the first member with respect to the second member; the third member may comprise a ring disposed around the mandrel and operable to move between the first and second positions; in the first position, the ring may be disposed against the collet to limit radial movement of the second profile to prevent the first and second profiles from disengaging; and in the second position, the ring may not be disposed against the collet to permit the radial movement of the second profile to permit the first and second profiles to disengage. In an example implementation, the third member may comprise: (A) a latching sleeve disposed around the mandrel and operable to: (1) prevent the first and second members from disengaging when in the first position; and (2) permit the first and second members to disengage when in the second position; and (B) an actuation sleeve disposed around the mandrel and connected with the latching sleeve, wherein the actuation sleeve may define an annular space between the actuation sleeve and the mandrel, wherein the flowline may be fluidly connected with the annular space, and wherein the actuation sleeve may be operable to move axially with respect to the mandrel to move the latching sleeve from the first position to the second position upon the annular space receiving the fluid via the flowline. The apparatus may further comprise a biasing member operatively connected with the third member and the mandrel, and the biasing member may be operable to bias the third member from the second position toward the first position.

The flowline may be a flowline system comprising a first flowline and a second flowline, wherein the flowline fluidly connected with latching mechanism may be the first flowline, and wherein the flowline fluidly connected with the inflatable packer may be the second flowline.

The present disclosure also introduces a method comprising coupling an inflatable packer assembly to a tool string, wherein the inflatable packer assembly comprises: a mandrel comprising a flowline extending within the mandrel; an upper packer ring selectively axially movable with respect to the mandrel; a lower packer ring fixedly connected with the mandrel; a latching mechanism fluidly connected with the flowline; and an inflatable packer disposed around the mandrel and sealingly connected with the upper and lower packer rings, wherein the inflatable packer is fluidly connected with the flowline. The method may also comprise conveying the tool string in a downhole direction within a wellbore, and pumping a fluid into the flowline to: expand the inflatable packer away from the mandrel and against a sidewall of the wellbore; and operate the latching mechanism to permit the axial movement of the upper packer ring with respect to the mandrel. The method may also comprise conveying the tool string in an uphole direction within the wellbore while the latching mechanism is limiting the axial movement of the upper packer ring with respect to the mandrel.

The mandrel may further comprise: an upper port fluidly connecting the flowline with the latching mechanism; and a lower port fluidly connecting the flowline with the inflatable packer, wherein pumping the fluid into the flowline may transfer the fluid to the latching mechanism via the upper port and into the inflatable packer via the lower port.

Limiting the axial movement of the upper packer ring with respect to the mandrel may comprise connecting the upper packer ring with the mandrel via the latching mechanism, and pumping the fluid into the flowline may cause the latching mechanism to disconnect the upper packer ring from the mandrel to permit the axial movement of the upper packer ring with respect to the mandrel.

The latching mechanism may comprise: a first member connected with the upper packer ring; a second member connected with the mandrel; and a third member. Limiting the axial movement of the upper packer ring with respect to the mandrel may comprise: engaging the first and second members with each other to limit axial movement of the first member with respect to the second member; and maintaining the third member in a first position in which at least a portion of the third member prevents the first and second members from disengaging. Operating the latching mechanism may comprise moving the third member to a second position in which the at least a portion of the third member permits the first and second members to disengage to permit the axial movement of the upper packer ring with respect to the mandrel. In the first position, the at least a portion of the third member may be disposed against the second member to prevent the second member from elastically bending to prevent the first and second members from disengaging, and in the second position, the at least a portion of the third member may not be disposed against the second member to permit the second member to elastically bend to permit the first and second members to disengage. In an example implementation, the first member may comprise an internal profile, the second member may comprise an external profile, engaging the first and second members with each other may comprise engaging the first and second profiles with each other to limit axial movement of the first member with respect to the second member, maintaining the third member in the first position may comprise maintaining the third member disposed between the mandrel and the second member to limit radially inward movement of the second member to prevent the internal and external profiles from disengaging, and operating the latching mechanism to move the third member to the second position may comprise operating the latching mechanism to move the at least a portion of the third member such that the third member is not disposed between the mandrel and the second member to permit the radially inward movement of the second member to permit the internal and external profiles to disengage. In an example implementation: (A) the third member may comprise: (1) a latching sleeve disposed around the mandrel and configured to: (i) prevent the first and second members from disengaging when in the first position; and (ii) permit the first and second members to disengage when in the second position; and (2) an actuation sleeve disposed around the mandrel and connected with the latching sleeve, wherein the actuation sleeve may define an annular space between the actuation sleeve and the mandrel, and wherein the flowline may be fluidly connected with the annular space; and (B) pumping the fluid into the flowline may transfer the fluid into the annular space causing the actuation sleeve to move axially with respect to the mandrel to axially move the latching sleeve from the first position to the second position. Maintaining the third member in the first position may comprise biasing the third member toward the first position via a biasing member.

The inflatable packer may be an upper inflatable packer, the inflatable packer assembly may further comprise a lower inflatable packer, pumping the fluid into the flowline may expand the lower inflatable packer to isolate a section of the wellbore between the upper and lower inflatable packers, and the method may further comprise, after conveying the tool string in the downhole direction within the wellbore and before conveying the tool string in the uphole direction within the wellbore, performing a formation evaluation operation within the isolated section.

The method may further comprise, after conveying the tool string in the downhole direction within the wellbore and before conveying the tool string in the uphole direction within the wellbore, transferring the fluid away from the inflatable packer and the latching mechanism via the flowline to: retract the inflatable packer toward the mandrel away from the sidewall of the wellbore; and cause the latching mechanism to limit the axial movement of the upper packer ring with respect to the mandrel. Transferring the fluid away from the inflatable packer via the flowline to retract the inflatable packer may be caused by operating a fluid valve to permit the fluid within the inflatable packer to flow out of the inflatable packer in response to pressure differential between hydrostatic wellbore pressure external to the inflatable packer and fluid pressure inside the inflatable packer.

The foregoing outlines features of several embodiments so that a person having ordinary skill in the art may better understand the aspects of the present disclosure. A person having ordinary skill in the art should appreciate that they may readily use the present disclosure as a basis for designing or modifying other processes and structures for carrying out the same functions and/or achieving the same benefits of the implementations introduced herein. A person having ordinary skill in the art should also realize that such equivalent constructions do not depart from the spirit and scope of the present disclosure, and that they may make various changes, substitutions and alterations herein without departing from the spirit and scope of the present disclosure.

The Abstract at the end of this disclosure is provided to permit the reader to quickly ascertain the nature of the technical disclosure. It is submitted with the understanding that it will not be used to interpret or limit the scope or meaning of the claims.

What is claimed is:

1. An apparatus comprising: a dual packer assembly for conveyance within a wellbore, wherein the dual packer assembly comprises: an upper packer assembly comprising: an upper mandrel; a first upper packer ring axially movable with respect to the upper mandrel; a first lower packer ring fixedly connected with the upper mandrel; and an upper inflatable packer disposed around the upper mandrel and sealingly connected with the first upper and first lower packer rings, wherein the upper inflatable packer is operable to expand against a sidewall of the wellbore; and a lower packer assembly comprising: a lower mandrel coupled with the upper mandrel; a second upper packer ring fixedly connected with the lower mandrel; a second lower packer ring axially movable with respect to the lower mandrel; and a lower inflatable packer disposed around the lower mandrel and sealingly connected with the second upper and second lower packer rings, wherein the lower inflatable packer is operable to expand against the sidewall of the wellbore, and wherein the upper and lower inflatable packers are collectively operable to isolate a section of the wellbore when expanded;

wherein the upper packer assembly further comprises a latching mechanism selectively operable back and forth between a first position and a second position, wherein the latching mechanism limits the axial movement of the first upper packer ring with respect to the upper mandrel when in the first position, and wherein the latching mechanism permits the axial movement of the first upper packer ring with respect to the upper mandrel when in the second position.

2. The apparatus of claim 1 wherein the latching mechanism connects the first upper packer ring with the upper mandrel to limit the axial movement of the first upper packer ring with respect to the upper mandrel when in the first position; and wherein the latching mechanism disconnects the first upper packer ring from the upper mandrel to permit the axial movement of the first upper packer ring with respect to the upper mandrel when in the second position.

3. The apparatus of claim 1 wherein the dual packer assembly further comprises a flowline extending within the upper and lower mandrels, wherein the flowline is fluidly connected with the latching mechanism, and wherein the latching mechanism is operable to permit the axial movement of the first upper packer ring with respect to the upper mandrel upon being actuated from the first position to the second position by a fluid from the flowline.

4. The apparatus of claim 3 wherein the flowline is fluidly connected with the upper and lower inflatable packers, wherein the upper and lower inflatable packers are operable to expand against the sidewall of the wellbore upon receiving the fluid from the flowline, and wherein the latching mechanism is operable to permit the axial movement of the first upper packer ring with respect to the upper mandrel while the upper and lower inflatable packers are being expanded against the sidewall of the wellbore.

5. The apparatus of claim 1 wherein:

the upper mandrel comprises a first outer profile having a first diameter;

the first upper packer ring, the first lower packer ring, and the upper inflatable packer are disposed about the first outer profile;

the upper mandrel further comprises a lower coupler coupled with an upper coupler of the lower mandrel; and the lower coupler has a second diameter that is substantially greater than the first diameter.

6. The apparatus of claim 5 wherein the lower coupler is at a lower end of the upper mandrel opposite an upper end of the upper mandrel, and wherein the upper mandrel is configured to receive thereon the first upper packer ring, the first lower packer ring, and the upper inflatable packer at the upper end of the mandrel during assembly of the dual packer assembly.

7. An apparatus comprising:

an inflatable packer assembly configured to be conveyed within a wellbore, wherein the inflatable packer assembly comprises:

a mandrel comprising a flowline;

a first packer ring slidably connected with the mandrel;

a second packer ring fixedly connected with the mandrel;

a latching mechanism fluidly connected with the flowline, wherein the latching mechanism is selectively operable back and forth between a first position and a second position, and wherein:

the latching mechanism is configured to limit movement of the first packer ring with respect to the mandrel when in the first position, the latching mechanism is configured to permit the movement of the first packer ring with respect to the mandrel when in the second position, the latching mechanism is actuated from the first position to the second position by flowing a fluid from the flowline into a port of the latching mechanism, and the latching mechanism is actuated from the second position to the first position by flowing the fluid from the port into the flowline; and an inflatable packer disposed around the mandrel and sealingly connected with the first and second packer rings, wherein the inflatable packer is fluidly connected with the flowline, and wherein the inflatable packer is operable to expand against a sidewall of the wellbore upon receiving the fluid from the flowline.

8. The apparatus of claim 7 wherein the first packer ring is an upper packer ring and the second packer ring is a lower packer ring.

9. The apparatus of claim 8 wherein:

the inflatable packer assembly is an upper packer assembly;

the mandrel is an upper mandrel;

the first packer ring is a first upper packer ring;

the second packer ring is a first lower packer ring;

the inflatable packer is an upper packer; and the apparatus further comprises a lower packer assembly comprising:

a lower mandrel coupled with the upper mandrel, a second upper packer ring fixedly connected with the lower mandrel;

a second lower packer ring slidably connected with the lower mandrel; and a lower packer disposed around the lower mandrel and operable to expand against the sidewall of the wellbore, wherein the upper and lower packers are collectively operable to isolate a section of the wellbore when expanded.

10. The apparatus of claim 7 wherein the fluid transmitted via the flowline:

simultaneously expands the inflatable packer and operates the latching mechanism to permit the movement of the first packer ring with respect to the mandrel.

11. The apparatus of claim 7 wherein the latching mechanism is operable to:

connect the first packer ring with the mandrel to limit the movement of the first packer ring with respect to the mandrel; and upon being actuated by the fluid from the flowline, disconnect the first packer ring from the mandrel to permit the movement of the first packer ring with respect to the mandrel.

12. The apparatus of claim 7 wherein the latching mechanism comprises:

a first member connected with the first packer ring;

a second member connected with the mandrel, wherein the first and second members are operable to engage each other to limit the movement of the first member with respect to the second member to limit the movement of the first packer ring with respect to the mandrel; and a third member operable to, upon being actuated by the fluid from the flowline, move from the first position in which at least a portion of the third member prevents the first and second members from disengaging to the second position in which the at least a portion of the third member permits the first and second members to disengage to permit the movement of the first packer ring with respect to the mandrel.

13. The apparatus of claim 12 wherein:

in the first position, the at least a portion of the third member is disposed against the second member to prevent the second member from elastically bending to prevent the first and second members from disengaging; and in the second position, the at least a portion of the third member is not disposed against the second member to permit the first member to elastically bend to permit the first and second members to disengage.

14. The apparatus of claim 7 wherein the latching mechanism comprises a latching sleeve and a biasing member, wherein the latching sleeve is disposed around the mandrel and configured to move axially with respect to the mandrel between the first position and the second position, and wherein the biasing member is configured to bias the actuation sleeve from the second position toward the first position.

15. A method comprising:

coupling a dual packer assembly to a tool string, wherein the dual packer assembly comprises:

an upper packer assembly comprising:

an upper mandrel comprising a first flowline extending within the upper mandrel;

a first upper packer ring selectively axially movable with respect to the upper mandrel;

a first lower packer ring fixedly connected with the upper mandrel;

a latching mechanism fluidly connected with the first flowline; and an upper inflatable packer disposed around the upper mandrel and sealingly connected with the first upper and first lower packer rings, wherein the upper inflatable packer is fluidly connected with the first flowline; and a lower packer assembly comprising:

a lower mandrel comprising a second flowline extending within the lower mandrel;

a second upper packer ring fixedly connected with the lower mandrel;

a second lower packer ring selectively axially movable with respect to the lower mandrel; and a lower inflatable packer disposed around the lower mandrel and sealingly connected with the second upper and second lower packer rings, wherein the lower inflatable packer is fluidly connected with the second flowline;

conveying the tool string in a downhole direction within a wellbore;

pumping a fluid into the first and second flowlines to:

expand the upper and lower inflatable packers away from the mandrel and against a sidewall of the wellbore; and operate the latching mechanism to permit the axial movement of the first upper packer ring with respect to the upper mandrel; and conveying the tool string in an uphole direction within the wellbore while the latching mechanism is limiting the axial movement of the first upper packer ring with respect to the upper mandrel.

16. The method of claim 15 wherein limiting the axial movement of the first upper packer ring with respect to the upper mandrel comprises connecting the first upper packer ring with the upper mandrel via the latching mechanism, and wherein pumping the fluid into the flowline causes a latching sleeve of the latching mechanism to move axially with respect to the upper mandrel from a first position to a second position to disconnect the first upper packer ring from the upper mandrel to permit the axial movement of the first upper packer ring with respect to the upper mandrel.

17. The method of claim 15 wherein:

the latching mechanism comprises:

a first member connected with the first upper packer ring;

a second member connected with the upper mandrel; and a third member;

limiting the axial movement of the first upper packer ring with respect to the upper mandrel comprises:

engaging the first and second members with each other to limit axial movement of the first member with respect to the second member; and maintaining the third member in a first position in which at least a portion of the third member prevents the first and second members from disengaging; and operating the latching mechanism comprises moving the third member to a second position in which the at least a portion of the third member permits the first and second members to disengage to permit the axial movement of the first upper packer ring with respect to the upper mandrel.

18. The method of claim 17 further comprising, after conveying the tool string in the downhole direction within the wellbore and before conveying the tool string in the uphole direction within the wellbore, transferring the fluid away from the upper inflatable packer and the latching mechanism via the first flowline to:

retract the upper inflatable packer toward the upper mandrel away from the sidewall of the wellbore; and cause the latching mechanism to limit the axial movement of the first upper packer ring with respect to the upper mandrel by moving the third member to the first position.

19. The method of claim 15 further comprising: after conveying the tool string in the downhole direction within the wellbore and before conveying the tool string in the uphole direction within the wellbore, performing a formation evaluation operation within the isolated section.

* * * * *